US010847085B2

(12) United States Patent
Kim et al.

(10) Patent No.: US 10,847,085 B2
(45) Date of Patent: Nov. 24, 2020

(54) ORGANIC LIGHT EMITTING DISPLAY DEVICE AND DRIVING METHOD THEREOF

(71) Applicant: Samsung Display Co., Ltd., Yongin-Si (KR)

(72) Inventors: Ji Tae Kim, Yongin-si (KR); Young Seob Kim, Yongin-si (KR)

(73) Assignee: Samsung Display Co., Ltd. (KR)

( * ) Notice: Subject to any disclaimer, the term of this patent is extended or adjusted under 35 U.S.C. 154(b) by 29 days.

(21) Appl. No.: 16/022,332

(22) Filed: Jun. 28, 2018

(65) Prior Publication Data

US 2019/0012961 A1 Jan. 10, 2019

(30) Foreign Application Priority Data

Jul. 4, 2017 (KR) ..... 10-2017-0084964

(51) Int. Cl.
*G09G 3/3225* (2016.01)
*G09G 3/3266* (2016.01)
(Continued)

(52) U.S. Cl.
CPC ..... *G09G 3/3225* (2013.01); *G09G 3/001* (2013.01); *G09G 3/3233* (2013.01);
(Continued)

(58) Field of Classification Search
CPC .. G09G 3/3233; G09G 3/3225; G09G 3/3266; G09G 2320/0626; G09G 2310/0262
See application file for complete search history.

(56) References Cited

U.S. PATENT DOCUMENTS 9,165,506 B2 10/2015 Gu et al.
9,691,837 B2 6/2017 Kim et al.
(Continued)

FOREIGN PATENT DOCUMENTS

KR 10-0629587 B1 9/2006
KR 10-2014-0083399 A 7/2014
KR 10-2016-0058330 A 5/2016

OTHER PUBLICATIONS

Ronald T. Azuma,"Predictive Tracking for Augmented Reality", University of North Carolina, 1995.
(Continued)

*Primary Examiner* — Abbas I Abdulselam
(74) *Attorney, Agent, or Firm* — Innovation Counsel LLP

(57) ABSTRACT

An organic light emitting display device comprises a first pixel region including first pixels which are driven in response to data signals when the organic light emitting display device is driven in a first mode and a second mode; a first scan driver which supplies scan signals to first scan lines connected to the first pixels; and a first light emitting driver which supplies light emission control signals to first light emission control lines which are connected to the first pixels. During one frame period in the second mode, the first light emitting driver supplies K light emission control signals to each of the first light emission control lines when a still image is displayed in the first pixel region, and supplies J light emission control signals to each of the light emission control lines when a moving image is displayed in the first pixel region.

15 Claims, 20 Drawing Sheets

(51) Int. Cl.
*G09G 3/3275* (2016.01)
*G09G 3/00* (2006.01)
*G09G 3/3233* (2016.01)

(52) U.S. Cl.
CPC ..... *G09G 3/3266* (2013.01); *G09G 3/3275* (2013.01); *G09G 2300/0861* (2013.01); *G09G 2310/0221* (2013.01); *G09G 2310/0262* (2013.01); *G09G 2310/08* (2013.01); *G09G 2320/0247* (2013.01); *G09G 2320/0626* (2013.01); *G09G 2320/0673* (2013.01)

(56) References Cited

U.S. PATENT DOCUMENTS

2008/0068312 A1* 3/2008 Kim ..... G09G 3/2014 345/84
2012/0320278 A1* 12/2012 Yoshitani ..... H04N 5/144 348/725
2013/0181884 A1* 7/2013 Perkins ..... H04N 9/3147 345/1.3
2014/0176616 A1* 6/2014 Gu ..... G09G 3/3266 345/690
2016/0238236 A1* 8/2016 Im ..... F21V 33/0052
2017/0186357 A1* 6/2017 Zeng ..... G09G 3/3225

OTHER PUBLICATIONS

Jason J. Jerald, "Scene-Motion- and Latency-Perception Thresholds for Head-Mounted Displays", University of North Carolina, 2009.

* cited by examiner

SECOND MODE (STILL IMAGE)

SECOND MODE (MOVING IMAGE)

SECOND MODE (STILL IMAGE)

ORGANIC LIGHT EMITTING DISPLAY DEVICE AND DRIVING METHOD THEREOF

RELATED APPLICATIONS

This application claims priority and the benefit of Korean Patent Application No. 10-2017-0084964, filed on Jul. 4, 2017, in the Korean Intellectual Property Office, the entire contents of which are incorporated herein by reference in their entirety.

BACKGROUND

1. Field

Exemplary embodiments of the present disclosure relate to an organic light emitting display device and a driving method thereof, and particularly, to a display device which can increase display quality and a driving method thereof.

2. Description of the Related Art

Recently, various electronic devices are developed, one of which can be directly worn on a body. Each of the devices is usually called a wearable device.

Particularly, a head-mounted display device (hereinafter referred to as an "HMD"), which is an example of the wearable device, displays a realistic image to provide a high level of immersion, thereby, being used for variety of purposes including movie watching.

SUMMARY OF THE DISCLOSURE

Exemplary embodiments of the present disclosure are to provide an organic light emitting display device which can increase display quality and a driving method thereof.

According to one embodiment, an organic light emitting display device, which is driven in a second mode when being mounted on a wearable device and is driven in a first mode in other cases, includes a first pixel region that includes first pixels which are driven in response to data signals when the organic light emitting display device is driven in the first mode and the second mode; a first scan driver that supplies scan signals to first scan lines which are connected to the first pixels; and a first light emitting driver that supplies light emission control signals to first light emission control lines which are connected to the first pixels. During one frame period in the second mode, the first light emitting driver supplies k (k is a natural number greater than or equal to 2) light emission control signals to each of the first light emission control lines when a still image is displayed in the first pixel region, and supplies j (j is a natural number smaller than k) light emission control signals to each of the light emission control lines when a moving image is displayed in the first pixel region.

In the embodiment, during one frame period, total light emission time of the first pixels when the still image is displayed may be determined to be substantially the same as total light emission time of the first pixels when the moving image is displayed.

In the embodiment, k may be set to $2^X$ (x is 1, 2, 3, 4, . . . ) times of j.

In the embodiment, the organic light emitting display device may further include a data driver that supplies the data signals to data lines which are connected to the first pixels; a gamma driver that supplies gamma voltages to the data driver; an offset part that stores offset values for controlling voltage the gamma voltages; and a timing controller that controls the offset values.

In the embodiment, in the second mode, the timing controller controls the offset values such that brightness of a low gray level when the still image is displayed becomes less than that when moving image is displayed in the first pixel region.

In the embodiment, the low gray level may include at least one gray level of 50 or less gray levels.

In the embodiment, the organic light emitting display device may further include a second pixel region that includes second pixels which are driven in response to the data signal when the organic light emitting display device is driven in the first mode and are set to a non-light emission state when the organic light emitting display device is driven in the second mode.

In the embodiment, the organic light emitting display device may further include a third pixel region that includes third pixels which are driven in response to the data signal when the organic light emitting display device is driven in the first mode and are set to the non-light emission state when the organic light emitting display device is driven in the second mode.

According to another embodiment, an organic light emitting display device, which is driven in a second mode when being mounted on a wearable device and is driven in a first mode in other cases, includes a first pixel region that includes first pixels which are driven in response to data signals when the organic light emitting display device is driven in the first mode and the second mode; a first scan driver that supplies scan signals to first scan lines which are connected to the first pixels; and a first light emitting driver that supplies light emission control signals to first light emission control lines which are connected to the first pixels. During one frame period in the second mode, the first light emitting driver supplies the light emission control signals to each of the first light emission control lines during a first period when a still image is displayed in the first pixel region, and supplies the light emission control signals to each of the light emission control lines during a second period different from the first period when a moving image is displayed in the first pixel region.

In the embodiment, the first period may be shorter than the second period.

In the embodiment, during one frame period in the second mode, the first pixels emit light for a longer time when the still image is displayed than when the moving image is displayed.

In the embodiment, during one frame period in the second mode, the first light emitting driver supplies one or more light emission control signals to each of the first light emission control lines when the still image is displayed in the first pixel region.

In the embodiment, the organic light emitting display device may further include a data converter that changes bits of first data which is supplied from the outside and generates second data, when the organic light emitting display device is driven in the second mode and simultaneously displays the still image in the first pixel region.

In the embodiment, the second data may have a lower gray level value than the first data.

In the embodiment, the organic light emitting display device may further include a data driver that generates a data signal by using the second data when the organic light emitting display device is driven in the second mode and simultaneously displays the still image in the first pixel region, and generates a data signal by using the first data in other cases.

In the embodiment, the organic light emitting display device may further include a second pixel region that includes second pixels which are driven in response to the data signal when the organic light emitting display device is driven in the first mode and are set to a non-light emission state when the organic light emitting display device is driven in the second mode.

In the embodiment, the organic light emitting display device may further include a third pixel region that includes third pixels which are driven in response to the data signal when the organic light emitting display device is driven in the first mode and are set to a non-light emission state when the organic light emitting display device is driven in the second mode.

According to still another embodiment, a driving method of an organic light emitting display device that is driven in a second mode when being mounted on a wearable device and is driven in a first mode in other cases, and that includes pixels which are turned off when a light emission control signal is supplied, includes supplying k (k is a natural number greater than or equal to 2) light emission control signals to each of light emission control lines, when the organic light emitting display device is driven in the second mode and a still image is simultaneously displayed in a pixel region; and supplying j (j is a natural number smaller than k) light emission control signals to each of the light emission control lines, when the organic light emitting display device is driven in the second mode and a moving image is simultaneously displayed in the pixel region.

In the embodiment, during one frame period, total light emission time of the pixels when the still image is displayed may be determined to be substantially the same as total light emitting time of the pixels when the moving image is displayed.

In the embodiment, k may be set to $2^X$ (x is 1, 2, 3, 4, . . . ) times of j.

In an organic light emitting display device and a driving method thereof according to an embodiment of the present disclosure, when a display device is mounted on an HMD, the number of light emission control signals and/or widths of the light emission control signals supplied to each of light emission control lines in correspondence with a still image and a moving image are controlled.

For example, in the present disclosure, when a still image is displayed, more light emission control signals may be supplied than when a moving image is displayed such that a flicker phenomenon is minimized. In addition, in the present disclosure, when a still image is displayed, it is possible to supply a light emission control signal with a smaller width than when a moving image is displayed such that a flicker phenomenon is minimized. When the number of light emission control signals and/or widths of the light emission control signals supplied to each of light emission control lines are controlled in correspondence with the still image and the moving image, the flicker phenomenon in the still image may be minimized and a motion blur phenomenon in the moving image may be minimized.

DETAILED DESCRIPTION OF THE EMBODIMENT

Figure 1A:
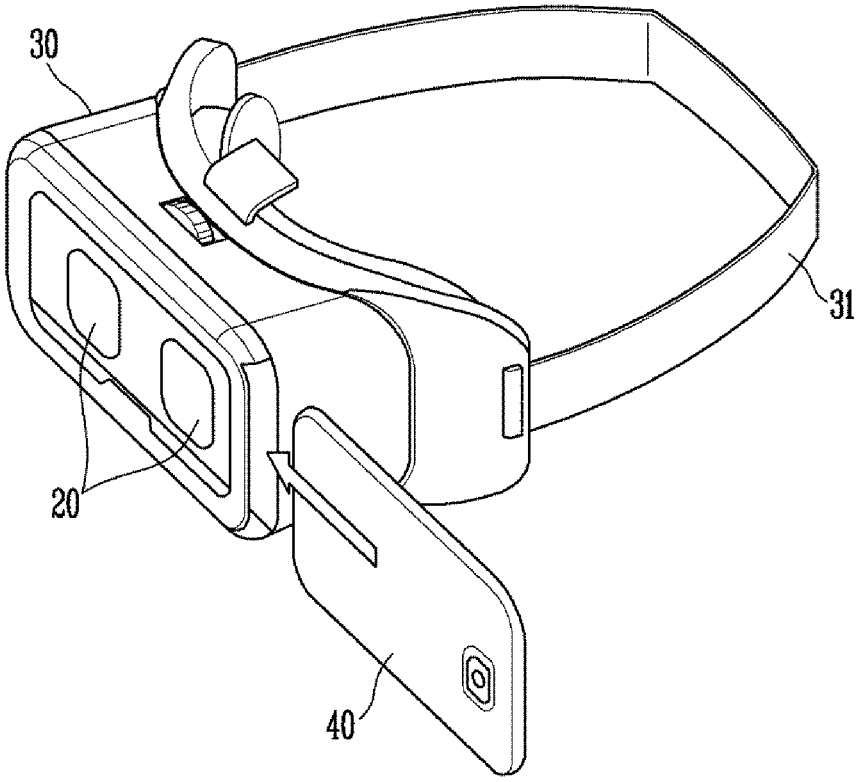
FIGS. 1A and 1B schematically illustrate a wearable device according to an embodiment.

Embodiments of the present disclosure and what is necessary for those skilled in the art to easily understand the contents of the present disclosure will be described in detail with reference to the accompanying drawings. However, the present disclosure may be embodied in many different forms within the scope of the appended claims, and thus, the embodiments which will be described below are exemplary only, regardless of expressions thereof.

That is, the present disclosure is not limited to the embodiments described below, and may be embodied in many different forms. In the following description, if it is described that one portion is connected to another portion, this includes not only a case where the portion is directly connected to another portion, but also a case where the portion is electrically connected to another portion through an element. In addition, it should be noted that the same elements in the drawings are denoted by the same reference numerals or symbols if possible, even if the elements are illustrated in different drawings.

Figure 1B:
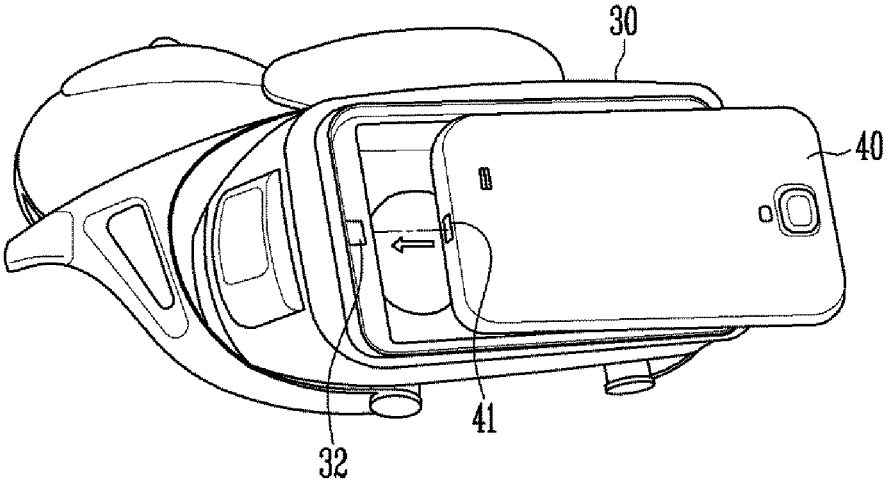

FIGS. 1A and 1B schematically illustrate a wearable device according to an embodiment. FIGS. 1A and 1B illustrate an HMD as an embodiment of the wearable device.

Referring to FIGS. 1A and 1B, the HMD according to the embodiment includes a body portion 30.

The body portion 30 includes a band 31. The user can wear the body portion 30 on the head by using the band 31. The body portion 30 has a structure in which a display device 40 can be detachably mounted.

The display device 40 that can be mounted on the HMD may be, for example, a smart phone. However, the display device 40 in the embodiment of the present disclosure is not limited to a smart phone. For example, the display device 40 may be any one of electronic devices including display means such as a tablet PC, an electronic book reader, a Personal Digital Assistant (PDA), a portable multimedia player (PMP), and a camera. Here, an organic light emitting display may be used as the display means.

If the display device 40 is mounted on the body portion 30, a connection portion 41 of the display device 40 is electrically connected to a connection portion 32 of the body portion 30, and thereby, the body portion 30 can communicate with the display devices 40. The HMD may include at least one of a touch panel, a button, and a wheel key which are not illustrated in order to control the display device 40.

If the display device 40 is mounted on the HMD, the display device 40 can be driven in a second mode, and if the display device 40 is separated from the HMD, the display device 40 can be driven in a first mode. If the display device 40 is mounted on the HMD, a drive mode of the display device 40 can be automatically switched to the second mode, and can be switched to the second mode in accordance with setting of a user.

In addition, if the display device 40 is separated from the HMD, the drive mode of the display device 40 may be automatically switched to the first mode, and may be switched to the first mode in accordance with the setting of the user.

The HMD includes lenses 20 corresponding to two eyes of a user. Each of the lenses 20 may be a fisheye lens, a wide-angle lens, or the like in order to enhance a field of view (FOV) of the user.

If the display device 40 is fixed to the body portion 30, the user observes the display device 40 through the lenses 20, and thus, the user may obtain effects such as viewing a moving image with a large screen at a certain distance.

Meanwhile, since the user observes the display device 40 through the lenses 20, an effective display portion is divided into a high visibility region and a low visibility region. For example, on the basis of both eyes of the user, a central region has high visibility and the other regions have low visibility.

Therefore, if the display device 40 is driven in the second mode such that a more vivid moving image can be displayed for the user, the moving image is displayed only in a part of the effective display portion. If the moving image is displayed only in a part of the effective display portion, a drive frequency may increase, and thus, the display device 40 may display a vivid moving image. In addition, a gate-off voltage is supplied to signal lines (scan lines, light emission control lines, and the like) located in the remaining regions except for a part of the effective display portion, and thereby, pixels located in the remaining regions are set to a non-light emission state.

Figure 2:
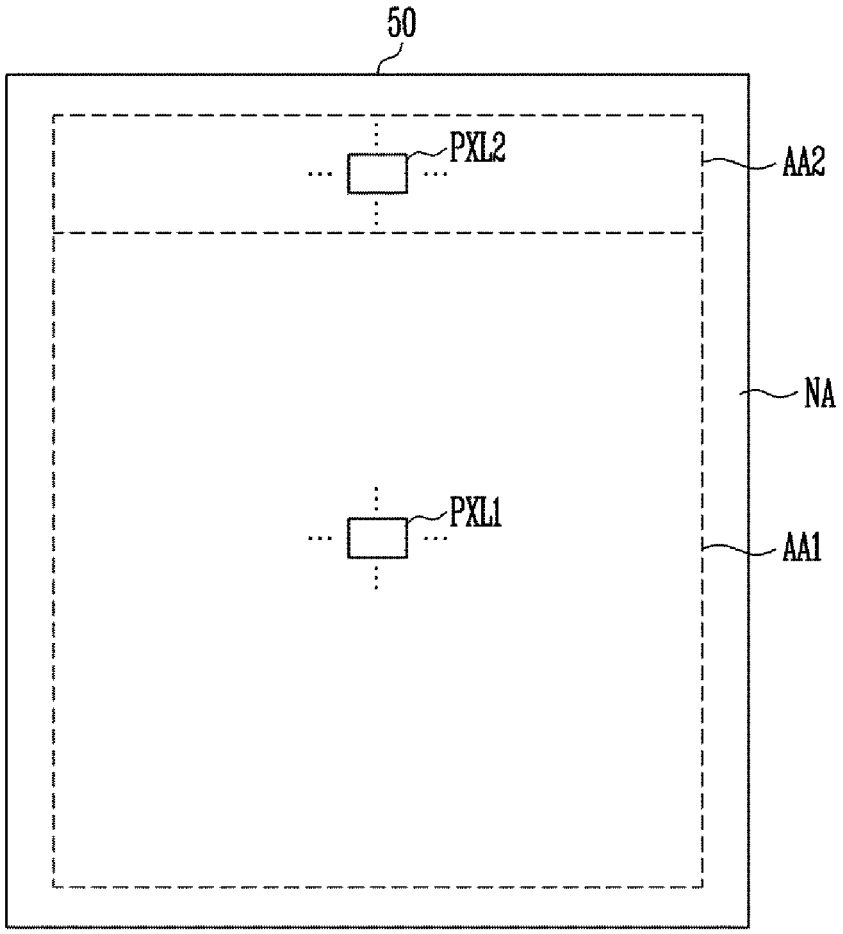
FIG. 2 illustrates a pixel region of a display device according to an embodiment.

FIG. 2 illustrates a pixel region of a display device according to an embodiment. For the sake of convenient description, it is assumed that the display device is an organic light emitting display device.

Referring to FIG. 2, the organic light emitting display device according to the embodiment of the present disclosure includes pixel regions AA1 and AA2 and a peripheral region NA. The pixel regions AA1 and AA2, and the peripheral region NA may be formed on a substrate 50.

A plurality of pixels PXL1 and PXL2 are located in the pixel regions AA1 and AA2, and thereby, a predetermined moving image is displayed in the pixel regions AA1 and AA2. Therefore, the pixel regions AA1 and AA2 may be effective display regions.

Figure 3:
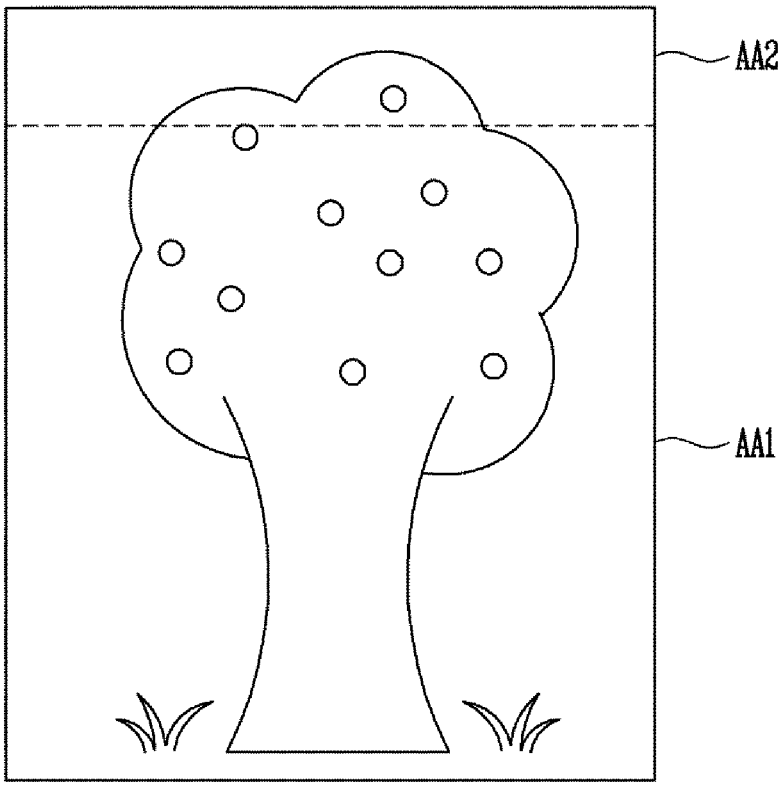
FIGS. 3 and 4 illustrate embodiments of display regions corresponding to a first mode and second mode in the display device of FIG. 2.

If the organic light emitting display device is driven in the first mode, a predetermined moving image is displayed in the first pixel region AA1 and the second pixel region AA2 as illustrated in FIG. 3.

Figure 4:
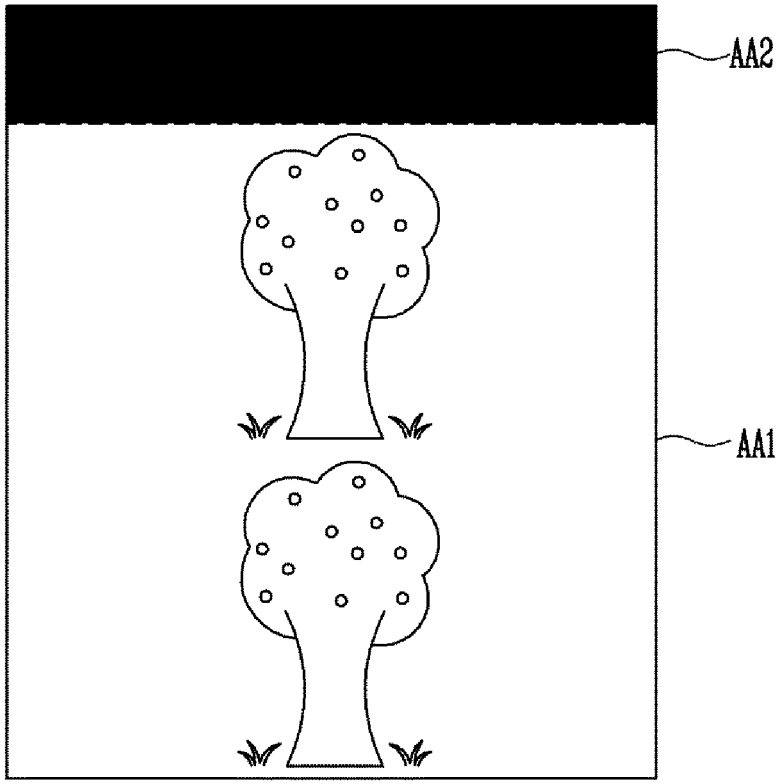

If the organic light emitting display device is driven in the second mode, a predetermined moving image is displayed only in the first pixel region AA1 as illustrated in FIG. 4. In this case, the moving image displayed in the first pixel region AA1 may be displayed as the same moving image or two different moving images corresponding to two eyes of a user. Actually, the moving image displayed in the first pixel region AA1 may be variously set corresponding to the characteristics of the HMD and the like.

If the organic light emitting display device is driven in the second mode, second pixels PXL2 included in the second pixel region AA2 are set to a non-light emission state. For example, if the organic light emitting display device is driven in the second mode, a black screen may be displayed in the second pixel region AA2.

In addition, if the organic light emitting display device is driven in the second mode, some data signals corresponding to the first pixel region AA1 may be supplied to the second pixel region AA2. Also in this case, the second pixels PXL2 included in the second pixel region AA2 may be set to the non-light emission state in response to a light emission control signal. That is, in the embodiment of the present disclosure, the second pixel region AA2 may be driven in various forms during a period when the organic light emitting display device is driven in the second mode.

Meanwhile, widths of the first pixel region AA1 and the second pixel region AA2 illustrated in FIG. 2 are the same, however, the present disclosure is not limited to this. For example, the second pixel region AA2 may have a shape that becomes narrower as the second pixel region gets farther away from the first pixel region AA1.

In addition, the second pixel region AA2 may be set to a narrower width than that of the first pixel region AA1. In this case, the number of second pixels PXL2 formed in a horizontal line of the second pixel region AA2 may be set to be smaller than the number of first pixels PXL1 formed in a horizontal line of the first pixel region AA1.

In the embodiment, the substrate 50 may have various shapes such that the pixel regions AA1 and AA2 are formed on the substrate 50. The substrate 50 may be formed of an insulating material such as glass, resin, or the like. In addition, the substrate 50 may be formed of a material with flexibility so as to be bent or folded, and may have a single-layer structure or a multi-layer structure.

Some elements (for example, drivers and wires) that drive the pixels PXL1 and PXL2 are disposed in the peripheral region NA. The pixels PXL1 and PXL2 do not exist in the peripheral region NA, and thus, the peripheral region NA may be a non-display region. The peripheral region NA exists around the pixel regions AA1 and AA2 and may have a shape surrounding at least a part of the pixel regions AA1 and AA2.

The pixel regions AA1 and AA2 include the first pixel region AA1 and the second pixel region AA2.

The first pixel region AA1 may have a larger area than the second pixel region AA2. The first pixels PXL1 are formed in the first pixel region AA1. The first pixels PXL1 generate light with predetermined brightness in response to a data signal.

The second pixel region AA2 is located on one side of the first pixel region AA1 and may have a smaller area than the first pixel region AA1. The second pixels PXL2 are formed in the second pixel region AA2. The second pixels PXL2 generate light with predetermined brightness in response to the data signal.

Each of the first pixels PXL1 and the second pixels PXL2 includes a drive transistor and an organic light emitting diode. The drive transistor controls the amount of currents supplied to the organic light emitting diode in response to the data signal.

Figure 5:
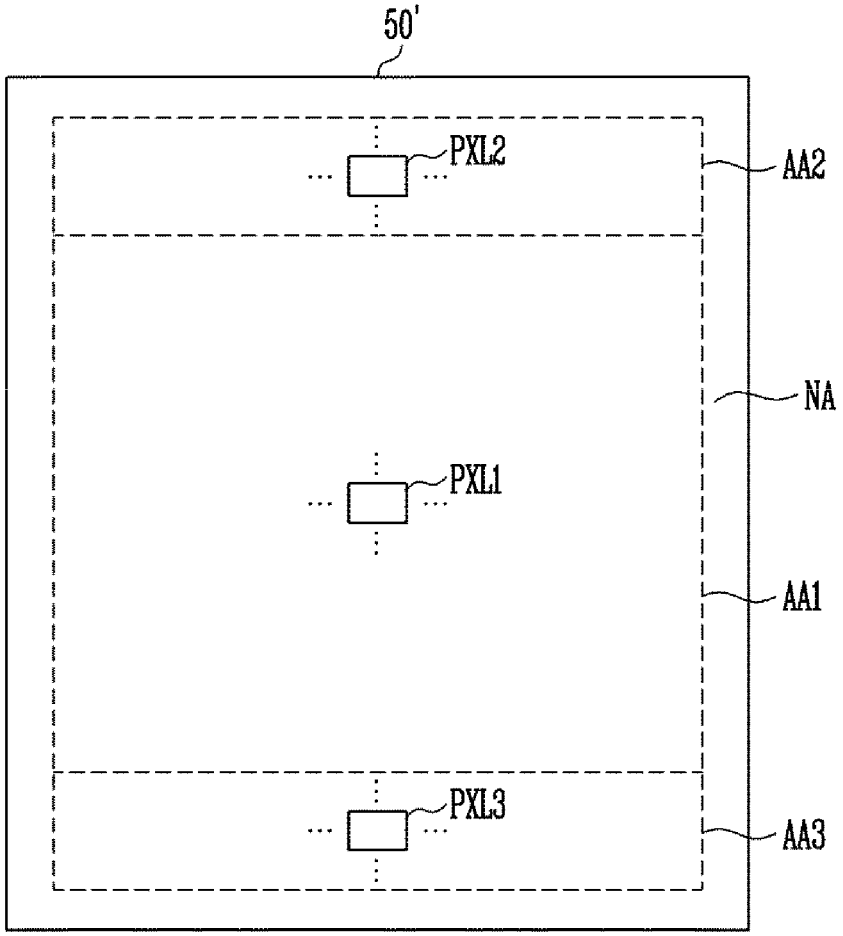
FIG. 5 illustrates a pixel region of an organic light emitting display device according to another embodiment.

FIG. 5 illustrates a pixel region of an organic light emitting display device according to another embodiment. When FIG. 5 is described, the same reference numerals or symbols will be assigned to the same configurations as those in FIG. 2, and detailed description thereof will be omitted.

Referring to FIG. 5, the organic light emitting display device according to another embodiment of the present disclosure includes pixel regions AA1, AA2, and AA3 and a peripheral region NA. The pixel regions AA1, AA2, and AA3 and the peripheral region NA may be formed on the substrate 50'.

A plurality of pixels PXL1, PXL2, and PXL3 are located in the pixel regions AA1, AA2, and AA3, and a predetermined moving image is displayed in the pixel regions AA1, AA2, and AA3. Therefore, the pixel regions AA1, AA2, and AA3 may be effective display portions.

Figure 6:
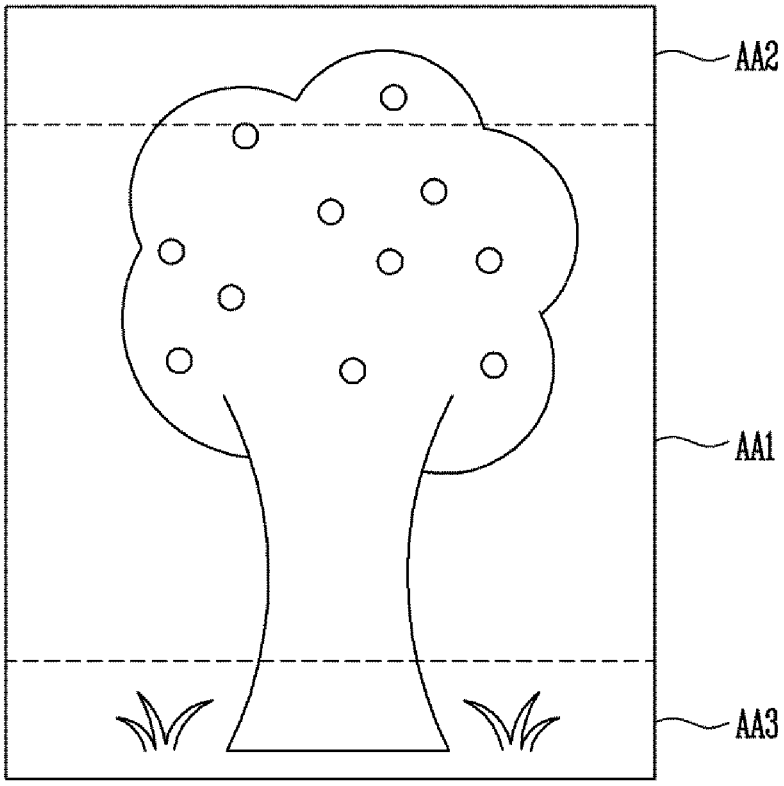
FIGS. 6 and 7 illustrate embodiments of display regions corresponding to a first mode and second mode in the display device of FIG. 5.

If the organic light emitting display device is driven in the first mode, predetermined moving images are displayed in the first pixel region AA1, the second pixel region AA2, and the third pixel region AA3 as illustrated in FIG. 6.

Figure 7:
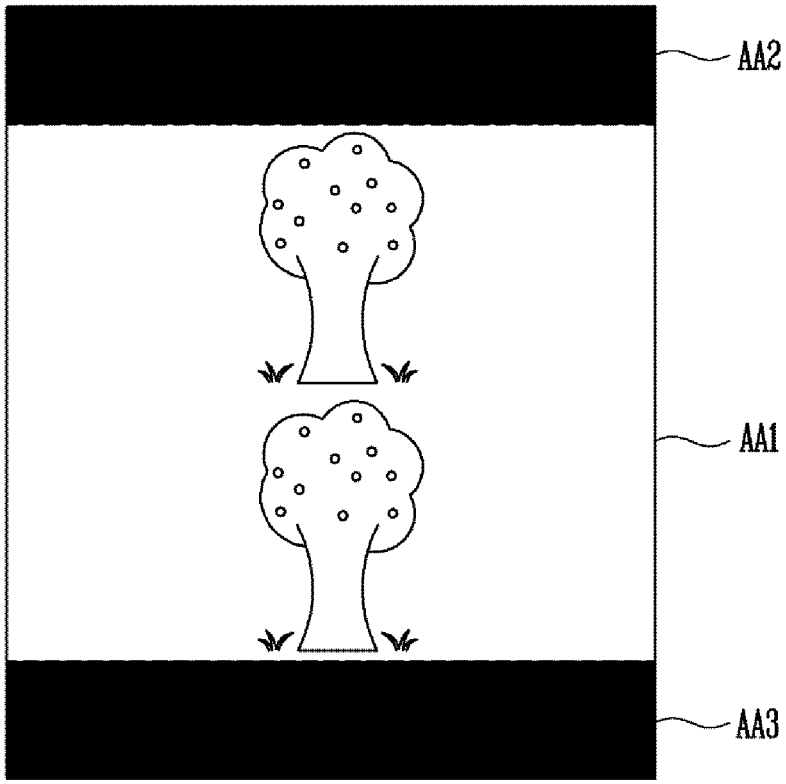

If the organic light emitting display device is driven in the second mode, a predetermined moving image is displayed only in the first pixel region AA1 as illustrated in FIG. 7. In this case, the second pixels PXL2 included in the second pixel region AA2 and the third pixels PXL3 included in the third pixel region AA3 are set to the non-light emission state. For example, if the organic light emitting display device is driven in the second mode, black screens may be displayed in the second pixel region AA2 and the third pixel region AA3.

In addition, if the organic light emitting display device is driven in the second mode, some data signals corresponding to the first pixel region AA1 may be supplied to the second pixel region AA2 and the third pixel region AA3. Also in this case, the second pixels PXL2 included in the second pixel region AA2 and the third pixels PXL3 included in the third pixel region AA3 may be set to the non-light emission state in response to a light emission control signal. That is, in the embodiment of the present disclosure, the second pixel region AA2 and the third pixel region AA3 may be driven in various forms during a period when the organic light emitting display device is driven in the second mode.

Constituent elements (for example, a driver and wires) that drive the pixels PXL1, PXL2, and PXL3 may be located in the peripheral region NA.

The pixel regions AA1, AA2, and AA3 include the first pixel region AA1, the second pixel region AA2, and the third pixel region AA3.

The second pixel region AA2 may be located on one side of the first pixel region AA1 and the third pixel region AA3 may be located on the other side of the first pixel region AA1. That is, the first pixel region AA1 may be located between the second pixel region AA2 and the third pixel region AA3.

The third pixel region AA3 may have a smaller area than the first pixel region AA1. The third pixels PXL3 are formed in the third pixel region AA3. The third pixels PXL3 generate light with predetermined brightness in response to the data signal.

Each of the first pixels PXL1, the second pixels PXL2, and the third pixels PXL3 includes a drive transistor and an organic light emitting diode. The drive transistor controls the amount of currents supplied to the organic light emitting diode in response to the data signal.

Figure 8:
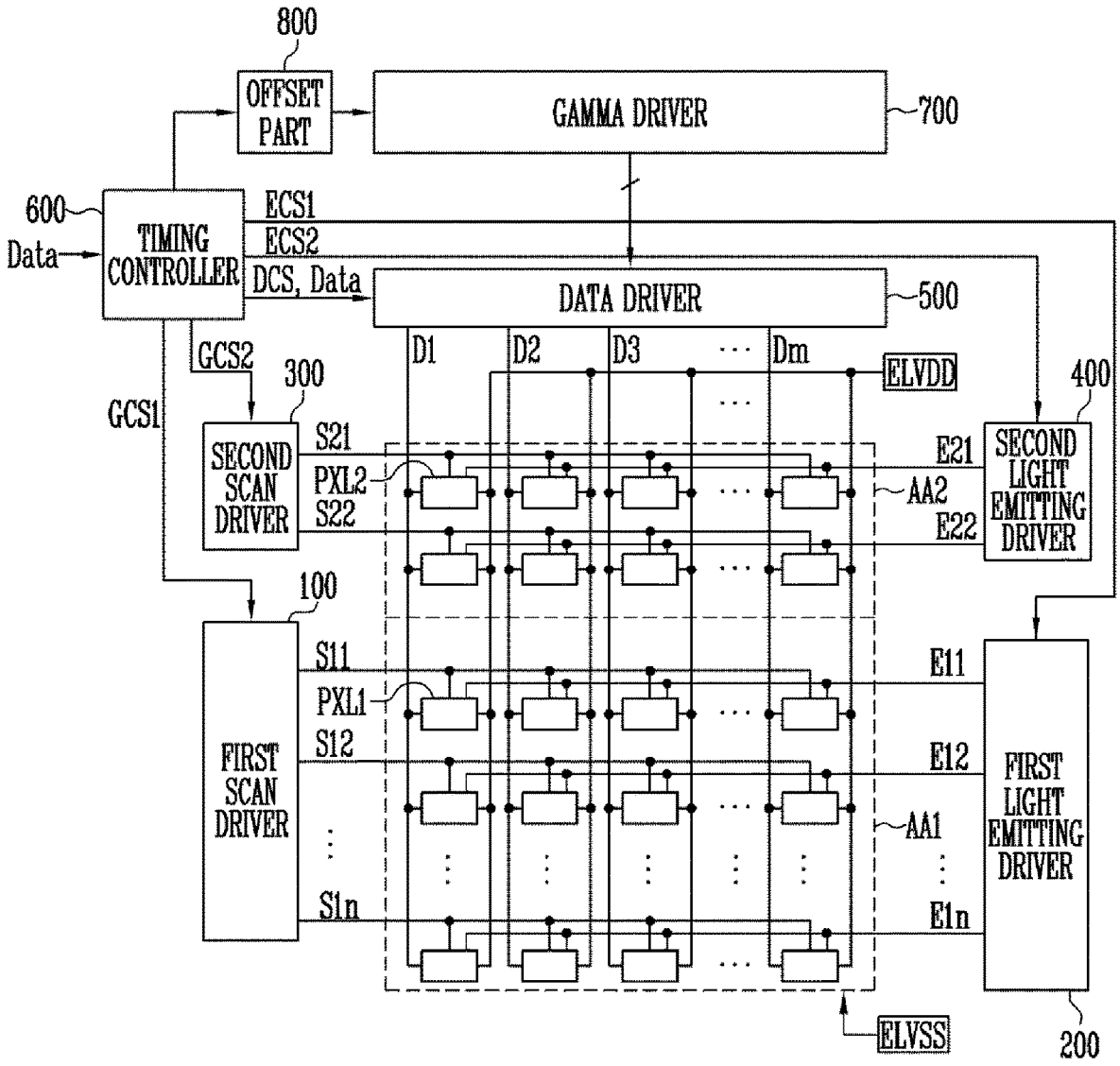
FIG. 8 illustrates an embodiment of the organic light emitting display device.

FIG. 8 illustrates an embodiment of the organic light emitting display device.

Referring to FIG. 8, the organic light emitting display device according to the embodiment of the present disclosure includes a first scan driver 100, a first light emitting driver 200, a second scan driver 300, a second light emitting driver 400, a data driver 500, a timing controller 600, a gamma driver 700, and an offset part 800.

A pixel region is divided into a first pixel region AA1 and a second pixel region AA2. The first pixel region AA1 includes first pixels PXL1 and the second pixel region AA2 includes second pixels PXL2.

The second pixels PXL2 are connected to second scan lines S21 and S22, second light emission control lines E21 and E22, and data lines D1 to Dm. The second pixels PXL2 are selected when second scan signals are supplied to the second scan lines S21 and S22, and receive data signals from the data lines D1 to Dm.

The second pixels PXL2 receiving data signals generate light with predetermined brightness in response to the data signals. Here, number of light emission times of the second pixels PXL2 is controlled by second light emission control signals supplied from the second light emission control lines E21 and E22.

The first pixels PXL1 are connected to the first scan lines S11 to S1*n*, the first light emission control lines E11 to E1*n*, and the data lines D1 to Dm. The first pixels PXL1 are selected when the first scan signals are supplied to the first scan lines S11 to S1*n* and receive the data signals from the data lines D1 to Dm.

The first pixels PXL1 receiving the data signals generate light with predetermined brightness in response to the data signals. Here, number of light emission times of the first pixels PXL1 is controlled by the first light emission control signals supplied from the first light emission control lines E11 to E1*n*.

Meanwhile, Although FIG. 8 illustrates two second scan lines S21 and S22 and two second light emission control lines E21 and E22 in the second pixel region AA2, the present disclosure is not limited to this. For example, two or more second scan lines S21 and S22 and two or more second light emission control lines E21 and E22 may be formed in the second pixel region AA2. In addition, one or more dummy scan lines and one or more dummy light emission control lines which are not illustrated may be additionally formed in the pixel regions AA1 and AA2 in correspondence with circuit structures of the pixels PXL1 and PXL2.

The second scan driver 300 supplies the second scan signals to the second scan lines S21 and S22 in response to a second gate control signal GCS2 from the timing controller 600. For example, the second scan driver 300 may sequentially supply the second scan signals to the second scan lines S21 and S22. If the second scan signals are sequentially supplied to the second scan lines S21 and S22, the second pixels PXL2 which are connected to the selected second scan line are sequentially selected by a horizontal line. To this end, the second scan signals are set to gate-on voltages such that transistors included in the second pixels PXL2 can be turned on.

Meanwhile, the second scan driver 300 supplies the second scan signals to the second scan lines S21 and S22 when the organic light emitting display device is driven in the first mode, and may not supply the second scan signals to the second scan lines S21 and S22 when the organic light emitting display device is driven in the second mode. In this case, when the organic light emitting display device is driven in the second mode, the second scan lines S21 and S22 are set to gate-off voltages.

The second light emitting driver 400 receives a second emission control signal ECS2 from the timing controller 600. The second light emitting driver 400 receiving the second emission control signal ECS2 supplies the second light emission control signals to the second light emission control lines E21 and E22. For example, the second light emitting driver 400 may sequentially supply the second light emission control signals to the second light emission control lines E21 and E22. The second light emission control signals are used to control number of light emission times of the second pixels PXL2. To this end, the second light emission control signals are set to the gate-off voltages such that the transistors included in the second pixels PXL2 can be turned off.

Meanwhile, the second light emitting driver 400 sequentially supplies the second light emission control signals to the second light emission control lines E21 and E22 when the organic light emitting display device is driven in the first mode. The second light emitting driver 400 may supply the second light emission control signals to the second light emission control lines E21 and E22 during a period of one frame, when the organic light emitting display device is driven in the second mode. In this case, when the organic light emitting display device is driven in the second mode, the second pixels PXL2 are set to a non-light emission state.

The first scan driver 100 supplies the first scan signals to the first scan lines S11 to S1*n* in response to a first gate control signal GCS1 from the timing controller 600. For example, the first scan driver 100 may sequentially supply the first scan signals to the first scan lines S11 to S1*n*. If the first scan signals are sequentially supplied to the first scan lines S11 to S1*n*, the first pixels PXL1 which are connected to the selected first scan line are sequentially selected by a horizontal line. To this end, the first scan signals are set to the gate-on voltages such that the transistors included in the first pixels PXL1 can be turned on.

Meanwhile, the first scan driver 100 supplies the first scan signals to the first scan lines S11 to S1*n* when the organic light emitting display device is driven in the first mode and the second mode. Accordingly, the first pixels PXL1 may display a predetermined moving image in response to the data signals regardless of the mode (the first mode or the second mode) of the organic light emitting display device.

The first light emitting driver 200 receives the first emission control signal ECS1 from the timing controller 600. The first light emitting driver 200 receiving the first emission control signal ECS1 supplies the first light emission control signals to the first light emission control lines E11 to E1*n*. For example, the first light emitting driver 200 may sequentially supply the first light emission control signals to the first light emission control lines E11 to E1*n*. The first light emission control signals are used to control the number of light emission times of the first pixels PXL1. To this end, the first light emission control signals are set to the gate-off voltages such that the transistors included in the first pixels PXL1 can be turned off.

Meanwhile, when the organic light emitting display device is driven in the second mode, the first light emitting driver 200 controls the number of light emission control signals supplied to each of the first light emission control lines E11 to En during a period of one frame. Details relating to this will be described below.

The gamma driver 700 generates a plurality of gamma voltages corresponding to gray levels. For example, the gamma driver 700 may generate 256 gamma voltages which are set to mutually different voltages corresponding to 256 gray levels.

The offset part 800 controls the gamma voltages. For example, by changing offset values stored in the offset part 800, the gamma voltages corresponding to at least one gray level may change.

The data driver 500 receives a data control signal DCS and data Data from the timing controller 600. The data driver 500 receiving the data control signal DCS and the data Data generates the data signals and supplies the data signals to the data lines D1 to Dm so as to be synchronized with the second scan signals and the first scan signals.

Here, the data driver 500 selects the gamma voltages corresponding to bits of the data Data for each channel, and supplies the selected gamma voltage to the data line (any one of D1 to Dm) connected to a channel as the data signal.

The timing controller 600 realigns the data Data supplied from the outside and supplies the data to the data driver 500. In addition, the timing controller 600 generates the first gate control signal GCS1, the second gate control signal GCS2, the first emission control signal ECS1, the second emission control signal GCS2, and the data control signal DCS, based on timing signals supplied from the outside.

The first gate control signal GCS1 generated by the timing controller 600 is supplied to the first scan driver 100 and the second gate control signal GCS2 is supplied to the second scan driver 300. The first emission control signal ECS1 generated by the timing controller 600 is supplied to the first light emitting driver 200 and the second emission control signal ECS2 is supplied to the second light emitting driver 400. In addition, the data control signal DCS generated by the timing controller 600 is supplied to the data driver 500.

In addition, the timing controller 600 may receive a signal corresponding to a moving image or a still image from the outside when the organic light emitting display device is driven in the second mode. The timing controller 600 receiving the signal corresponding to the moving image or the still image may control the voltage value of the gamma voltage generated by the gamma driver 700 by controlling the offset part 800. Details relating to this will be described below.

Each of the first gate control signal GCS1 and the second gate control signal GCS2 includes a start signal and a clock signal. The start signal controls supply timing of the first scan signal or the second scan signal. The clock signal is used to shift the start signal.

Each of the first emission control signal ECS1 and the second emission control signal ECS2 includes a light emission start signal and a clock signal. The light emission start signal controls supply timing of the first light emission control signal or the second light emission control signal. The clock signal is used to shift the light emission start signal.

The data control signal DCS includes a source start signal, a source output enable signal, a source sampling clock, and the like. The source start signal controls data sampling start time of the data driver 500. The source sampling clock controls a sampling operation of the data driver 500 on the basis of a rising edge or a falling edge. The source output enable signal controls output timing of the data driver 500.

Figure 9:
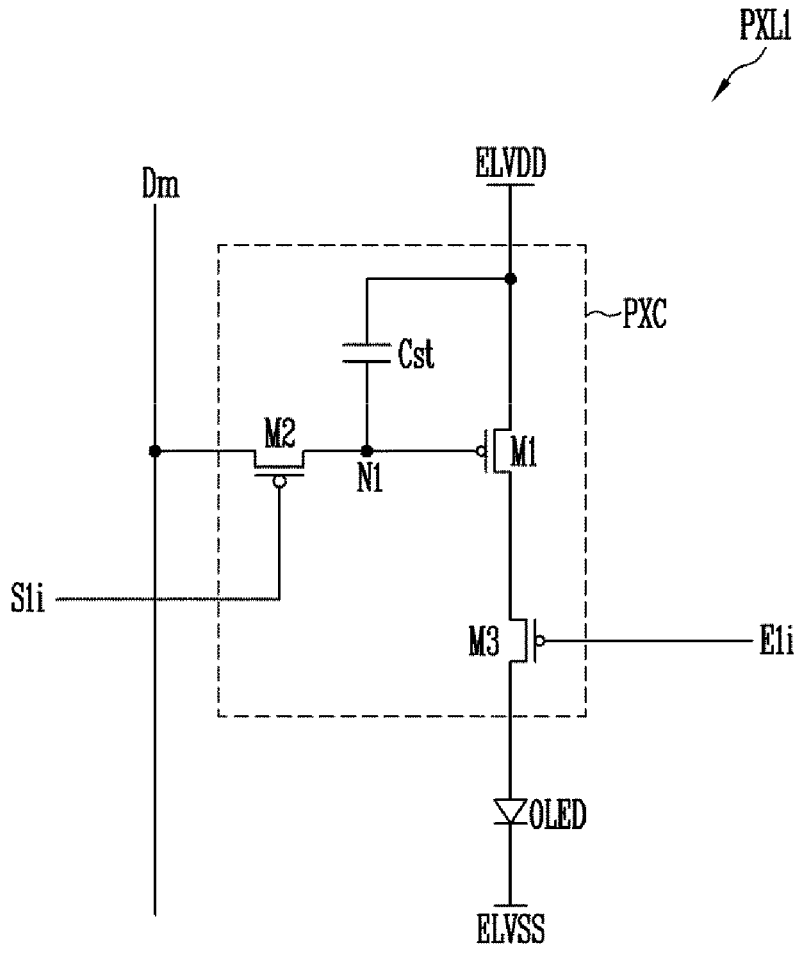
FIG. 9 illustrates an embodiment of a first pixel illustrated in FIG. 8.

FIG. 9 illustrates an embodiment of a first pixel illustrated in FIG. 8. FIG. 9 illustrates the first pixel PXL1 connected to an m-th (m is a natural number) data line Dm and an i-th (i is a natural number) first scan line S1*i* for the sake of convenient description.

Referring to FIG. 9, the first pixel PXL1 according to the embodiment of the present disclosure includes an organic light emitting diode OLED and a pixel circuit PXC for controlling the amount of currents supplied to the organic light emitting diode OLED.

An anode electrode of the organic light emitting diode (OLED) is connected to the pixel circuit PXC, and a cathode electrode thereof is connected to a second power supply ELVSS. The organic light emitting diode OLED generates light with predetermined brightness in accordance with the amount of currents supplied from the pixel circuit PXC. A first power supply ELVDD may be set to a higher voltage than the second power supply ELVSS such that a current can flow through the organic light emitting diode OLED.

The pixel circuit PXC controls the amount of currents supplied to the organic light emitting diode OLED in response to the data signal. To this end, the pixel circuit PXC includes a first transistor M1, a second transistor M2, a third transistor M3, and a storage capacitor Cst.

A first electrode of the first transistor M1 is connected to the first power supply ELVDD and a second electrode thereof is connected to the anode electrode of the organic light emitting diode OLED through the third transistor M3. A gate electrode of the first transistor M1 is connected to a first node N1. The first transistor M1 controls the amount of currents flowing from the first power supply ELVDD to the second power supply ELVSS through the organic light emitting diode OLED in accordance with a voltage of the first node N1.

The second transistor M2 is connected between the data line Dm and the first node N1. A gate electrode of the second transistor M2 is connected to the i-th first scan line S1*i*. The second transistor M2 is turned on when the first scan signal is supplied to the i-th first scan line S1*i*, thereby, electrically connecting the data line Dm to the first node N1.

The third transistor M3 is connected between the second electrode of the first transistor M1 and the anode electrode of the organic light emitting diode OLED. A gate electrode of the third transistor M3 is connected to the i-th first light emission control line E1*i*. The third transistor M3 is turned off when the light emission control signal is supplied to the i-th first light emission control line E1*i*, and is turned on in other cases.

The storage capacitor Cst is connected between the first power supply ELVDD and the first node N1. The storage capacitor Cst stores a voltage corresponding to the data signal.

An operation will be described hereinafter. First, the light emission control signal is supplied to the i-th first light emission control line E1*i*, and thereby, the third transistor M3 is turned off. when the third transistor M3 is turned off, the first transistor M1 and the organic light emitting diode OLED are electrically disconnected, and thereby, the organic light emitting diode OLED is set to the non-light emission state.

Thereafter, the first scan signal is supplied to the i-th first scan line S1*i*, and thereby, the second transistor M2 is turned on. when the second transistor M2 is turned on, the data signal from the data line Dm is supplied to the first node N1. At this time, the storage capacitor Cst stores a voltage corresponding to the data signal.

After the voltage of the data signal is stored in the storage capacitor Cst, supplying the first scan signal to the i-th first scan line S1*i* is stopped. when supplying the first scan signal to the i-th first scan line S1*i* is stopped, the second transistor M2 is turned off.

After the second transistor M2 is turned off, supplying the first light emission control signal to the i-th first light emission control line E1*i* is stopped. When supplying the first light emission control signal to the i-th first light emission control line E1*i* is stopped, the third transistor M3 is turned on.

When the third transistor M3 is turned on, the first transistor M1 is electrically connected to the organic light emitting diode OLED. At this time, the first transistor M1 controls the amount of currents supplied to the organic light emitting diode OLED in accordance with the voltage of the first node N1. Then, the organic light emitting diode OLED generates light with predetermined brightness in accordance with the amount of currents supplied from the first transistor M1.

Actually, the first pixels PXL1 according to the embodiment of the present disclosure generate light with predetermined brightness in response to the data signal while repeating the above-described processes.

Meanwhile, in the embodiment of the present disclosure, a structure of the first pixel PXL1 is not limited to the structure illustrated in FIG. 9. For example, as long as the first pixel PXL1 is connected to the first scan line (any one of S11 to S1*n*) and the first light emission control line (any one of E11 to E1*n*), in the embodiment of the present disclosure.

In addition, the second pixel PXL2 has the same circuit structure as the first pixel PXL1, and detailed description thereof will be omitted.

Figure 10:
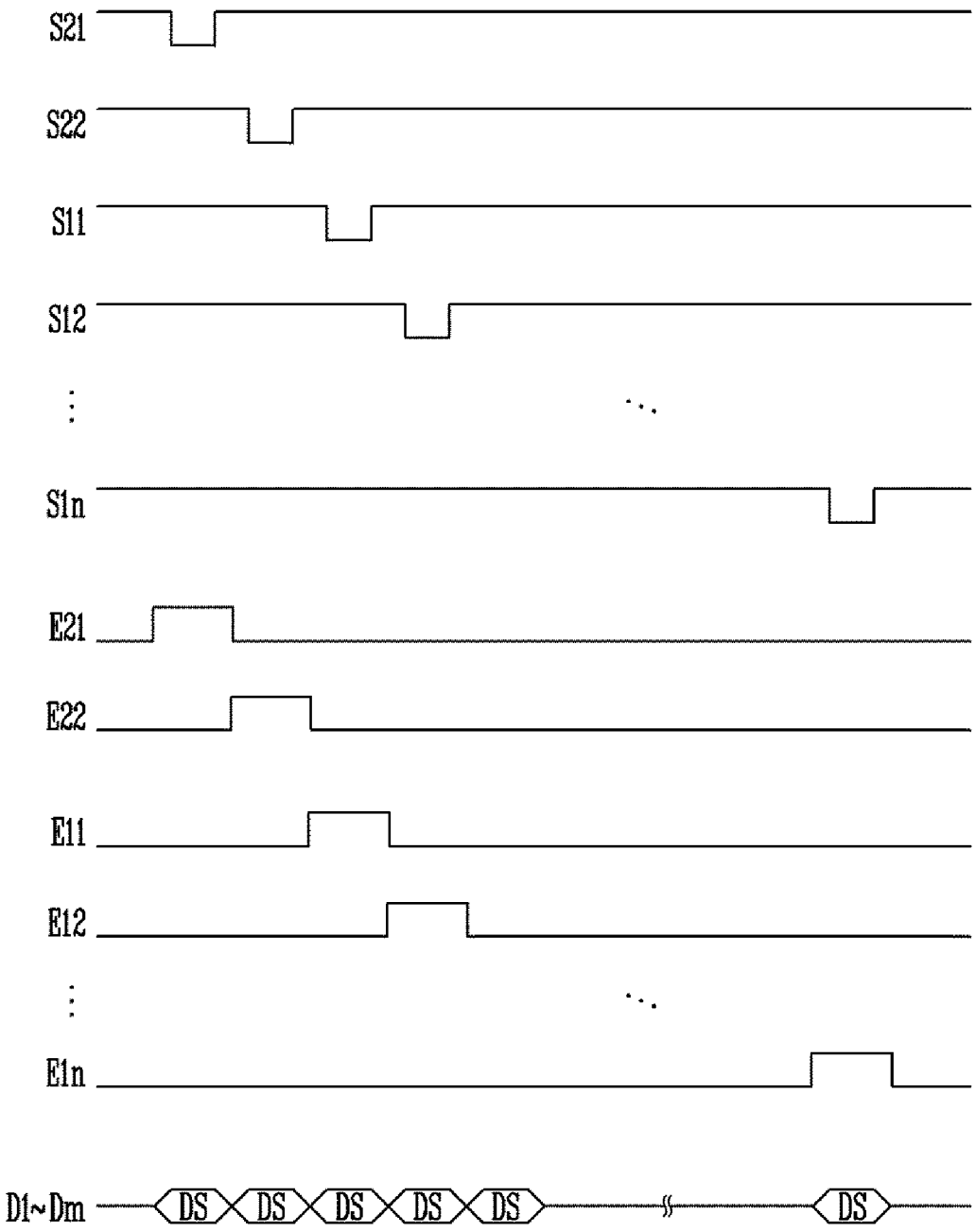
FIG. 10 is a waveform diagram illustrating an embodiment of a driving method when the organic light emitting display device is driven in a first mode.

FIG. 10 is a waveform diagram illustrating an embodiment of a driving method when the organic light emitting display device is driven in the first mode.

Referring to FIG. 10, when the organic light emitting display device is driven in the first mode, the scan signals (that is, the second scan signal and the first scan signal) are sequentially supplied to the second scan lines S21 to S22 and the first scan lines S11 to S1*n*. If the scan signals are sequentially supplied to the second scan lines S21 to S22 and the first scan lines S11 to S1*n*, the pixels PXL2 and PXL1 connected to the selected scan line are selected by a horizontal line.

When the organic light emitting display device is driven in the first mode, the data signal DS is supplied to the data lines D1 to Dm so as to be synchronized with the scan signal.

The data signal DS supplied to the data lines D1 to Dm is supplied to the pixel PXL2 or PXL1 selected by the scan signal.

In this case, a voltage corresponding to the data signal DS is stored in each of the pixels PXL2 and PXL1, and thereby, a predetermined moving image may be displayed in the first pixel region AA1 and the second pixel region AA2.

When the organic light emitting display device is driven in the first mode, the light emission control signals (that is, the second light emission control signal and the first light emission control signal) are sequentially supplied to the second light emission control lines E21 to E22 and the first light emission control lines E11 to E1*n*. If the light emission control signals are sequentially supplied to the second light emission control lines E21 to E22 and the first light emission control lines E11 to E1*n*, the pixels PXL2 and PXL1 connected to the emission control line which receives the light emission control signal do not emit light. That is, if the light emission control signals are sequentially supplied to the second light emission control lines E21 to E22 and the first light emission control lines E11 to E1*n*, the pixels PXL2 and PXL1 do not emit light during a period when the voltage corresponding to the data signal is stored in the pixels PXL2 and PXL1, and thus, it is possible to prevent unnecessary light from being supplied to the outside.

Meanwhile, when the organic light emitting display device is driven in the second mode, the light emission control signals are continuously supplied to the second light emission control lines E21 to E22, and thereby, the second pixels PXL2 are set to the non-light emission state.

Figure 11:
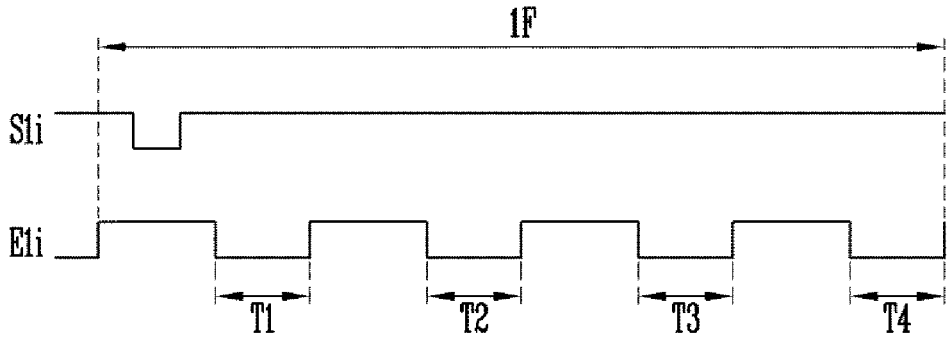
FIG. 11 is a waveform diagram illustrating an embodiment of the driving method when the organic light emitting display device is driven in a second mode and displays a still image.

FIG. 11 is a waveform diagram illustrating an embodiment of the driving method when the organic light emitting display device is driven in the second mode and displays a still image.

Referring to FIG. 11, the timing controller 600 receives a control signal corresponding to a still image or a moving image from the outside, when the display device is driven in the second mode.

If a control signal corresponding to a still image is supplied, the timing controller 600 generates the first emission control signal ECS1 such that a plurality of light emission control signals are supplied during a one frame period, and supplies the generated first emission control signal ECS1 to the first light emitting driver 200.

For example, the timing controller 600 may generate the first emission control signal ECS1 such that a plurality of light emission start signals are included during a one frame period 1F.

The first light emission driver 200 receiving the first emission control signal ECS1 supplies a plurality of light emission control signals to each of the first light emission control lines E11 to E1*n* during the one frame period 1F.

For example, the first light emitting driver 200 may supply four light emission control signals to the i-th first light emission control line E1*i* during the one frame period 1F. Here, any one of the four light emission control signals supplied to the i-th first light emission control line E1*i* overlaps the first scan signal supplied to the i-th first scan line S1*i*.

Figure 13:
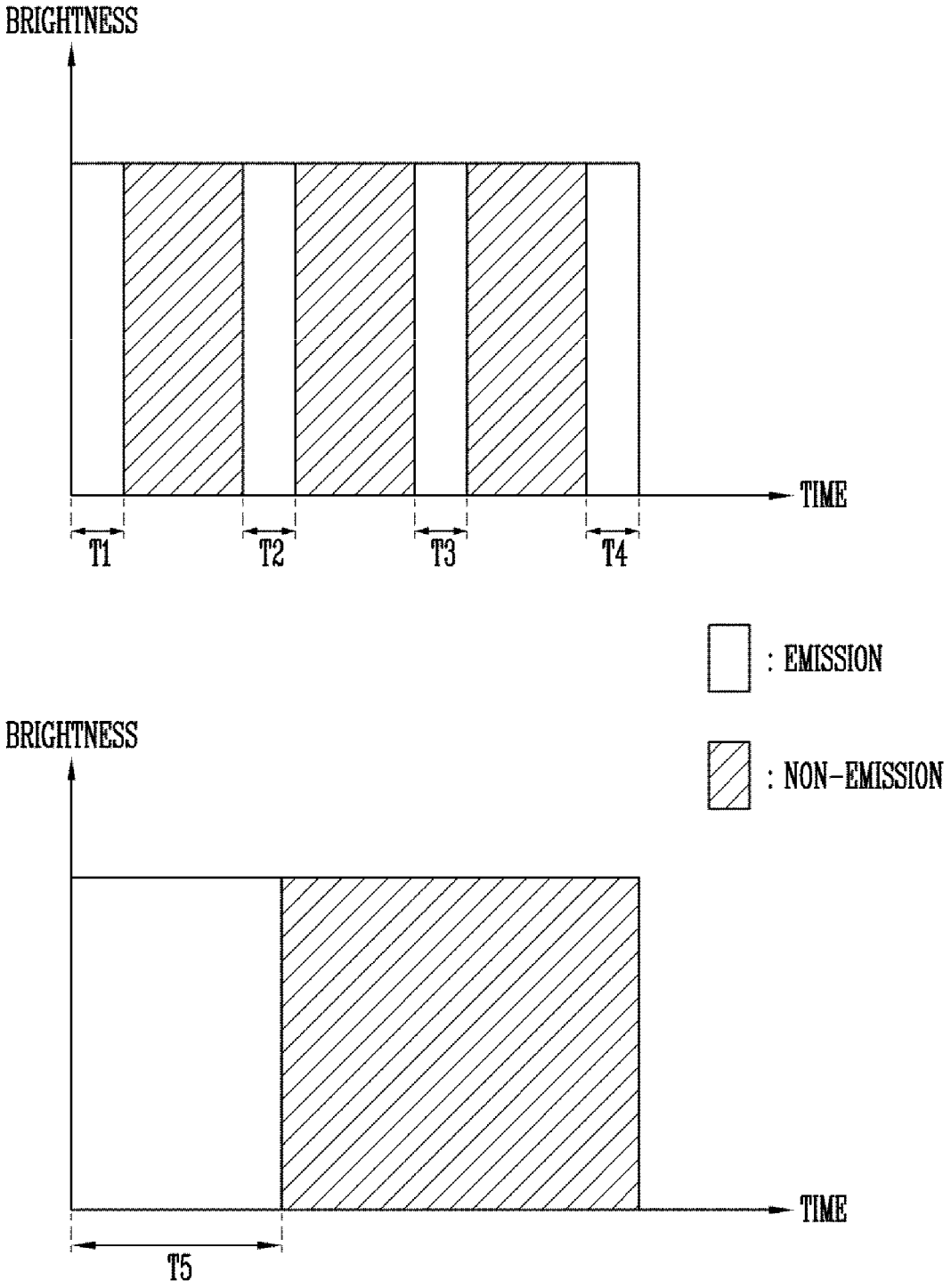
FIG. 13 illustrates light emission and non-light emission of a pixel corresponding to waveforms of FIGS. 11 and 12.

If the four light emission control signals are supplied to the i-th first light emission control line E1*i*, the first pixel PXL1 connected to the i-th first light emission control line E1*i* is set to a light emission state during a first period T1, a second period T2, a third period T3, and a fourth period T4 during one frame period 1F as illustrated in FIG. 13 (however, the first pixel PXL1 receiving a black data signal may be set to the non-light emission state). In addition, FIG. 13 illustrates number of light emission times of the first pixel PXL1 from the first period T1.

That is, in the embodiment of the present disclosure, if the organic light emitting display device is driven in the second mode and a still image is simultaneously displayed, the first pixel PXL1 may emit light during the first period, the second period T2, the third period T3, and the fourth period T4, with predetermined periods therebetween during the one frame period 1F, and thereby, a flicker phenomenon can be minimized.

In detail, if a user wears the HMD, a moving image is observed through the lenses 20. Accordingly, when the organic light emitting display device displays a still image, if a period when non-light emission becomes longer during a one frame period 1F, the user recognizes flicker. Meanwhile, if the first pixel PXL1 repeats light emission and non-light emission during the one frame period 1F in the same manner as the present disclosure, the flicker phenomenon can be prevented from occurring, and thereby, it is possible to improve display quality.

Figure 12:
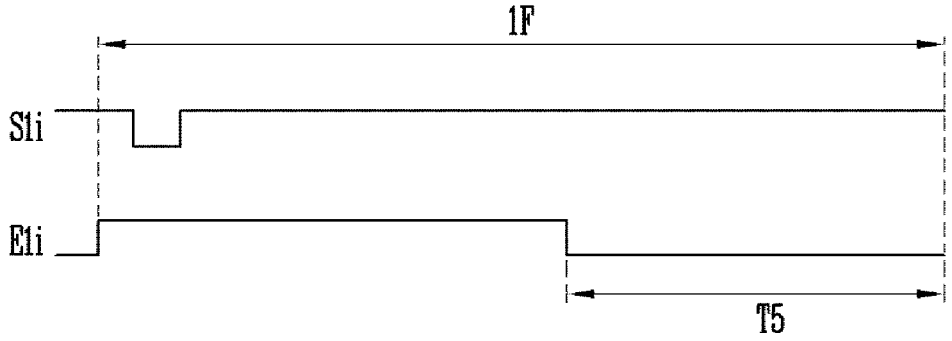
FIG. 12 is a waveform diagram illustrating an embodiment of the driving method when the organic light emitting display device is driven in the second mode and displays a moving image.

FIG. 12 is a waveform diagram illustrating an embodiment of the driving method when the organic light emitting display device is driven in the second mode and displays a moving image.

Referring to FIG. 12, first, when a display device is driven in the second mode, the timing controller 600 receives a control signal corresponding to a still image or a moving image from the outside.

If a control signal corresponding to a moving image is supplied, the timing controller 600 generates the first emission control signal ECS1 such that at least one light emission control signal is supplied during one frame period, and supplies the generated first emission control signal ECS1 to the first light emission driver (200).

For example, the timing controller 600 may generate the first emission control signal ECS1 such that at least one light emission start signal is included during the one frame period 1F.

The first light emission driver 200 receiving the first emission control signal ECS1 supplies at least one emission control signal to each of the first light emission control lines E11 to E1*n* during the one frame period 1F.

For example, the first light emitting driver 200 may supply one light emission control signal to the i-th first light emission control line E1*i*. Here, the one light emission control signal supplied to the i-th first light emission control line E1*i* overlaps the first scan signal supplied to the i-th first scan line S1*i*.

If one light emission control signal is supplied to the i-th first light emission control line E1*i*, the first pixel PXL1 connected to the i-th first light emission control line E1*i* is set to a light emission state during a fifth period T5 in the one frame period (however, the first pixel PXL1 receiving a black data signal may be set to the non-light emission state) as illustrated in FIG. 13. In addition, FIG. 13 illustrates number of light emission times of the first pixel PXL1 from the fifth period T5.

That is, in the embodiment of the present disclosure, if the organic light emitting display device is driven in the second mode and simultaneously displays a moving image, the first pixel PXL1 emits light during the fifth period T5 in the one frame period 1F, and thereby, it is possible to minimize a motion blur phenomenon.

In details, if a user wears the HMD, a moving image is observed through the lenses 20. If the first pixel PXL1 has a plurality of emitting periods during the one frame 1F when a moving image is displayed, the user recognizes motion blur. Meanwhile, if the first pixel PXL1 emits light once during the one frame period 1F as in the present disclosure, a motion blur phenomenon may be prevented from occurring, and thereby, it is possible to improve display quality.

Meanwhile, in the embodiment of the present disclosure, the total time when the first pixel PXL1 emits light during the one frame period 1F is set to be the same regardless of the still image and the moving image. For example, a period obtained by adding the first period T1, the second period T2, the third period T3, and the fourth period T4 together may be set to be the same as the fifth period T5.

In detail, if a user wears the HMD, the first pixel region AA1 displays a still image and/or a moving image on a screen. Here, when light emission time of one frame with the still image and the light emission time of one frame with the moving image are different from each other, a brightness difference may be recognized. Accordingly, in the embodiment of the present disclosure, when the still image and the moving image are displayed, not only the number of light emission control signals supplied to the first light emission control lines E11 to E1*n* is controlled, but also the light emission time is set to be the same. As such, the light emission time of the first pixel PXL1 is set to be the same during the one frame period 1F regardless of the still image and the moving image, and an image with uniform brightness may be displayed.

In summary, in the embodiment of the present disclosure, if the organic light emitting display device is driven in the second mode and simultaneously displays a still image in the first pixel region AA1, the first light emitting driver 200 supplies k (k is a natural number greater than or equal to 2) light emission control signals to each of the first light emission control lines E11 to E1*n*.

In addition, if the organic light emitting display device is driven in the second mode and simultaneously displays a moving image in the first pixel region AA1, the first light emitting driver 200 supplies j (j is a natural number smaller than k) light emission control signals to each of the first light emission control lines E11 to E1*n*. Here, k may be set to $2^X$ (x is 1, 2, 3, 4, . . . ) times of j.

In addition, in the embodiment of the present disclosure, when the organic light emitting display device is driven in the second mode, total number of light emission times of the first pixel PXL1 are set to be the same regardless of the still image and the moving image.

Figure 14:
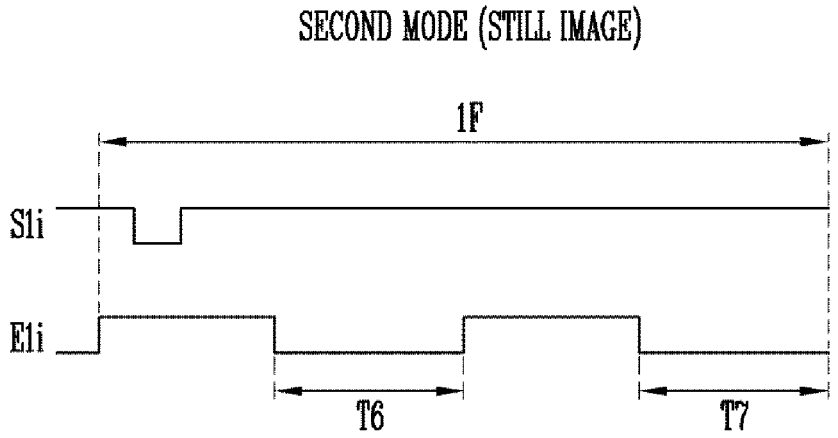
FIG. 14 is a waveform diagram illustrating another embodiment of the driving method when the organic light emitting display device is driven in the second mode and displays a still image.

FIG. 14 is a waveform diagram illustrating another embodiment of the driving method when the organic light emitting display device is driven in the second mode and displays a still image. In describing FIG. 14, parts relating to the parts described in FIG. 11 will be described in brief.

Referring to FIG. 14, when the display device is driven in the second mode, the timing controller 600 receives a control signal corresponding to a still image or a moving image from the outside.

If the control signal corresponding to the still image is supplied, the timing controller 600 generates the first emission control signal ECS1 such that a plurality of light emission control signals are supplied during a one frame period, and supplies the generated first emission control signal ECS1 to the first light emission driver 200.

For example, the timing controller 600 may generate the first emission control signal ECS1 such that a plurality of light emission start signals are included in the one frame period 1F.

The first emitting driver 200 receiving the first emission control signal ECS1 may supply a plurality of light emission control signals to each of the first light emission control lines E11 to E1*n* during the one frame period 1F.

For example, the first light emitting driver 200 may supply light emission control signals two times to the i-th first light emission control line E1*i* during one frame period 1F. If the light emission control signals are supplied to the i-th first light emission control line E1*i* two times, the first pixel PXL1 connected to the i-th first light emission control line E1*i* is set to a light emission state during a sixth period T6 and a seventh period T7 during the one frame period 1F.

Here, total time obtained by adding the sixth period T6 to the seventh period T7 is set to be the same as the fifth period T5 illustrated in FIG. 12.

Figure 15:
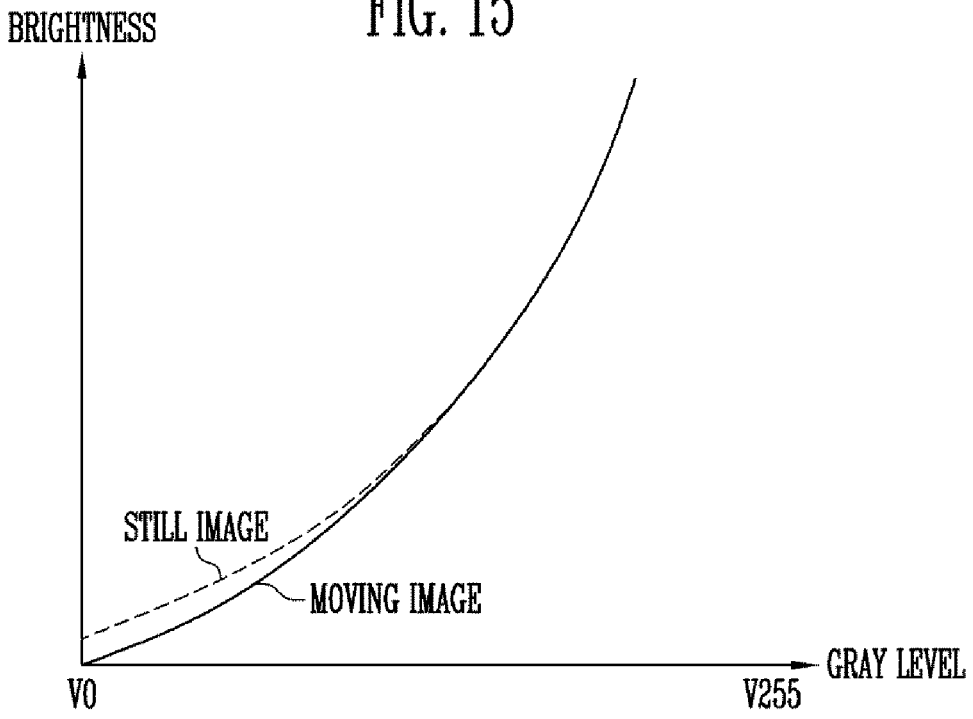
FIG. 15 is a graph illustrating a relationship between gray level and brightness generated by the waveforms of FIGS. 11 and 12.

FIG. 15 is a graph illustrating a relationship between gray level and brightness generated by drive waveforms of FIGS. 11 and 12.

Referring to FIG. 15, when the organic light emitting display device is driven in the second mode, the number of light emission control signals supplied to each of the first light emission control lines E11 to E1*n* in correspondence with the moving image and the still image is set differently.

In other words, when the moving image is displayed in the first pixel region AA1 as described above, j light emission control signals are supplied to each of the first light emission control lines E11 to E1*n*, and when the still image is displayed, k (larger than j) light emission control signals are supplied to each of the first light emission control lines E11 to E1*n*.

Here, if k light emission control signals are supplied to each of the first light emission control lines E11 to E1*n*, brightness is increased at a low gray level by a kickback voltage generated when the third transistor M3 included in the first pixel PXL1 is turned on and turned off.

In this case, the brightness of the low gray level displayed on the moving image and the brightness of the low gray level displayed on the still image are different from each other, and thereby, there is a concern that the display quality decreases.

Accordingly, in the embodiment of the present disclosure, when the organic light emitting display device is driven in the second mode and simultaneously displays the still image, the offset part 800 is controlled to decrease the brightness of the low gray level, and thus, a moving image with uniform brightness is displayed.

In details, when the organic light emitting display device is driven in the second mode, the timing controller 600 receives a control signal corresponding to a still image or a moving image from the outside.

If a control signal corresponding to the still image is supplied, the timing controller 600 controls the offset part 800 such that the brightness at a low gray level is decreased. In other words, the timing controller 600 controls the offset part 800 such that the brightness at a low gray level is decreased as compared with a case where a moving image is displayed.

If an offset value stored in the offset part 800 changes, a voltage value of a gamma voltage generated by the gamma driver 700 changes. For example, the gamma driver 700 may generate the gamma voltage such that brightness at a low gray level is decreased in accordance with the offset value stored in the offset part 800. Here, the low gray level includes at least one gray level of 50 or less gray levels.

Figure 16:
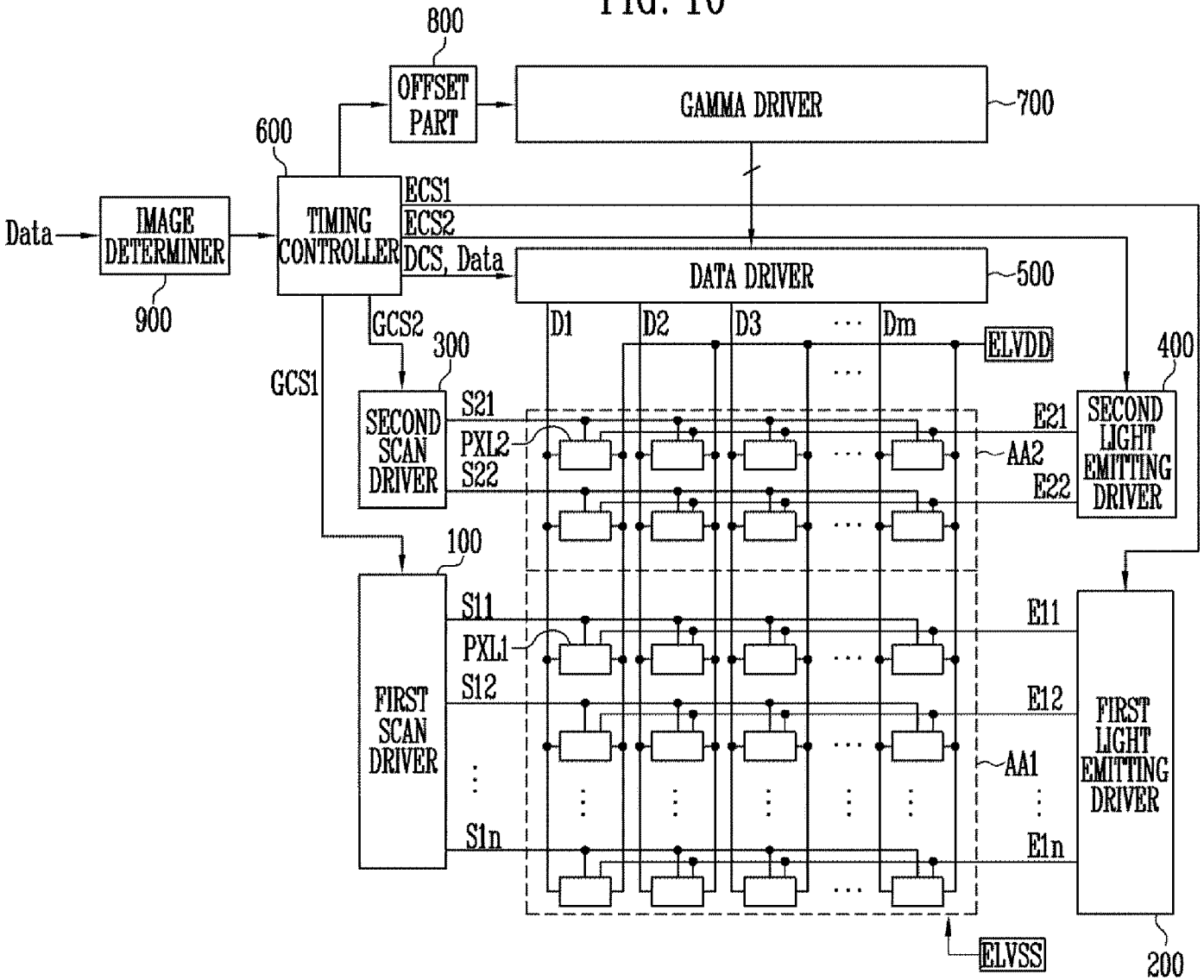
FIG. 16 illustrates another embodiment of the organic light emitting display device.

FIG. 16 illustrates another embodiment of the organic light emitting display device. When FIG. 16 is described, the same reference numerals or symbols will be assigned to the same configurations as those in FIG. 8, and detailed description thereof will be omitted.

Referring to FIG. 16, the organic light emitting display device according to another embodiment further includes an image determiner 900.

In the above description, it is described that the timing controller 600 receives a control signal corresponding to a moving image and a still image from the outside, but the present disclosure is not limited to this.

For example, the image determiner 900 may be added to the organic light emitting display device. The image determiner 900 determines whether an image displayed in the first pixel region AA1 is a moving image or a still image by using the data Data. Here, a method of determining an image by using the image determiner 900 may be selected from various known methods.

In addition, in the embodiment of the present disclosure, the first scan driver 100, the first light emitting driver 200, the second scan driver 300, the second light emitting driver 400, the data driver 500, the timing controller 600, The gamma driver 700, the offset part 800, and the image determiner 900 are separately illustrated, but the present disclosure is not limited to this.

For example, the first scan driver 100, the first light emitting driver 200, the second scan driver 300, the second light emitting driver 400, the data driver 500, the timing controller 600, the gamma driver 700, the offset part 800, and the image determiner 900 may be implemented as one or more integrated circuits.

Figure 17:
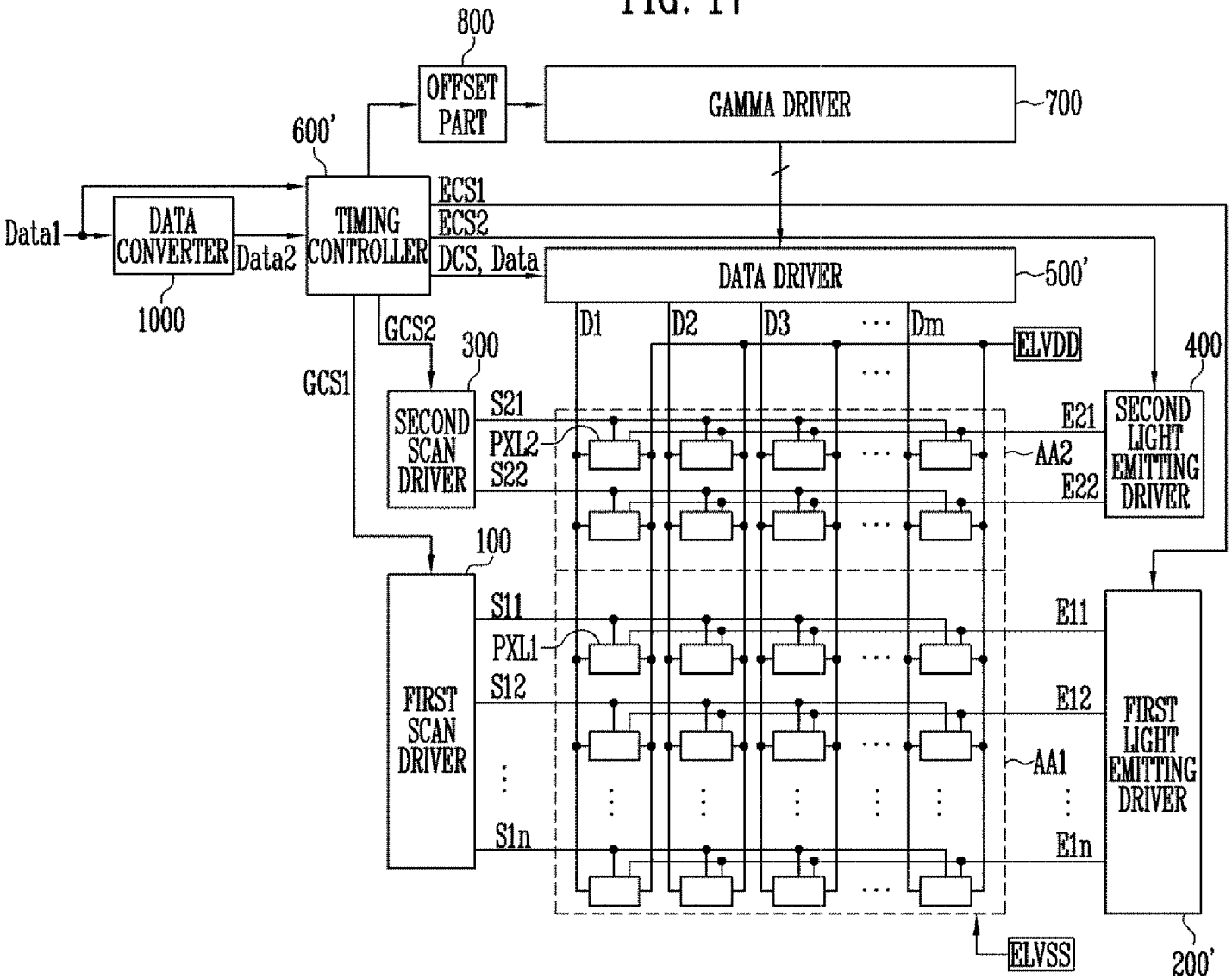
FIG. 17 illustrates still another embodiment of the organic light emitting display device.

FIG. 17 illustrates still another embodiment of the organic light emitting display device. When FIG. 17 is described, the same reference numerals or symbols will be assigned to the same configurations as those in FIG. 8, and detailed description thereof will be omitted.

Referring to FIG. 17, the organic light emitting display device according to another embodiment includes the first scan driver 100, a first light emitting driver 200', the second scan driver 300, the second light emitting driver 400, a data driver 500', a timing controller 600', a gamma driver 700, an offset part 800, and a data converter 1000.

The first light emitting driver 200' receives the first emission control signal ECS1 from the timing controller 600'. The first light emission driver 200' receiving the first emission control signal ECS1 supplies the first light emission control signals to the first light emission control lines E11 to E1*n*.

Here, when the organic light emitting display device is driven in the second mode, the first light emitting driver 200' controls a width of the control signal supplied to each of the first light emission control lines E11 to E1*n* during a one frame period in correspondence with a still image or a moving image. Detailed description relating to this will be made below.

The data converter 1000 receives first data Data1 from the outside. The data converter 1000 receiving the first data Data1 changes bits of the first data Data1 and generates second data Data2, when the organic light emitting display device is driven in the second mode and simultaneously displays the still image in the first pixel region AA1. Here, the second data Data2 is set to have a lower gray level than the first data Data1. In addition, the data converter 1000 does not generate the second data Data2, when the organic light emitting display device is driven in the first mode or the second mode and simultaneously displays a moving image in the first pixel region AA1.

The data driver 500' generates a data signal by using the first data Data1 supplied from the outside or the second data Data2 supplied from the data converter 1000. Here, the data driver 500' generates the data signal by using the first data Data1 when the organic light emitting display device is driven in the first mode or the second mode and simultaneously displays a moving image in the first pixel region AA1, and generates the data signal by using the second data Data2 when the electro-optical display device is driven in the second mode and simultaneously displays the still image in the first pixel region AA1.

The timing controller 600' supplies the first data Data1 to the data driver 500', when the organic light emitting display device is driven in the first mode or the second mode and simultaneously displays the moving image in the first pixel region AA1. The timing controller 600' supplies the second data Data2 to the data driver 500' when the organic light emitting display device is driven in the second mode and simultaneously displays the still image in the first pixel region AA1.

Figure 18:
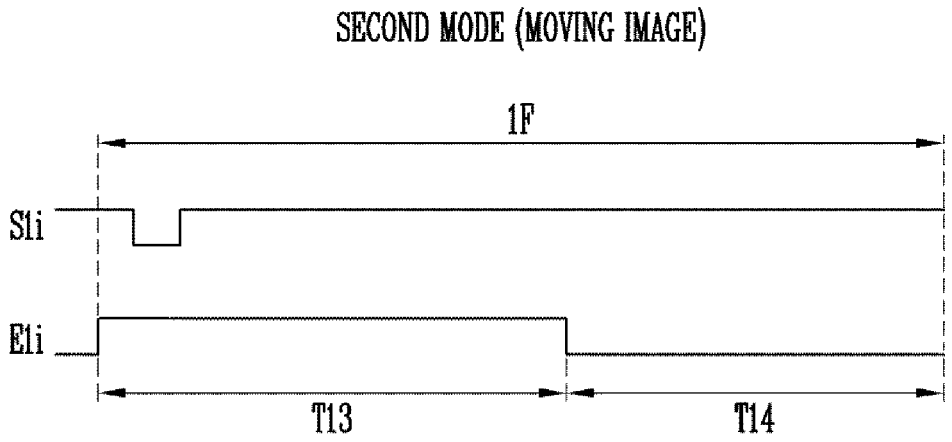
FIG. 18 is a waveform diagram illustrating an embodiment of a driving method when the organic light emitting display device of FIG. 17 is driven in a second mode and displays a moving image.

FIG. 18 is a waveform diagram illustrating an embodiment of the driving method when the organic light emitting display device illustrated in FIG. 17 is driven in the second mode and displays a moving image.

Referring to FIG. 18, first, the timing controller 600' receives a control signal corresponding to a still image or a moving image from the outside, when the organic light emitting display device is driven in the second mode.

If the control signal corresponding to the moving image is supplied, the timing controller 600' supplies the first emission control signal ECS1 to the first light emitting driver 200' such that the light emission control signal is supplied during a thirteenth period T13 in one frame period. If the light emission control signal is supplied during the thirteenth period T13 in the one frame period, the first pixel PXL1 is set to a light emission state during a fourteenth period T14. Here, the fourteenth period T14 may be set to be the same as the fifth period T5 illustrated in FIG. 12.

Figure 19:
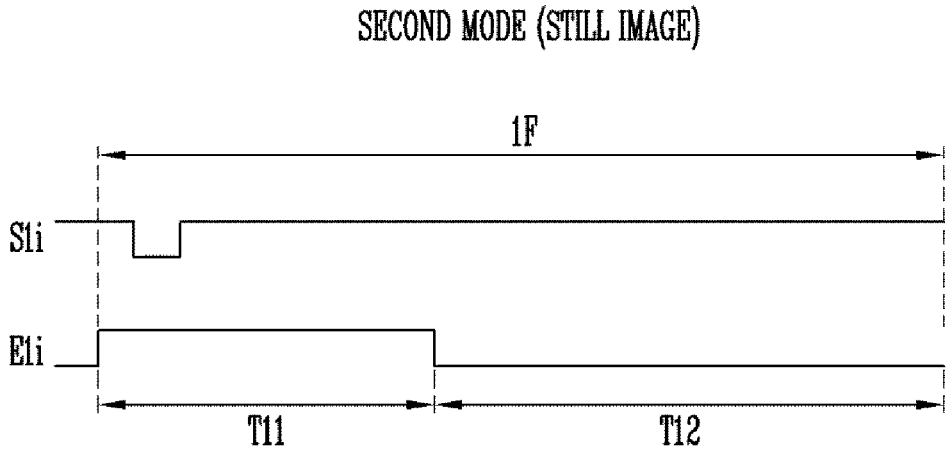
FIG. 19 is a waveform diagram illustrating an embodiment of the driving method when the organic light emitting display device of FIG. 17 is driven in the second mode and displays a still image.

FIG. 19 is a waveform diagram illustrating an embodiment of the driving method when the organic light emitting display device illustrated in FIG. 17 is driven in the second mode and displays the still image.

Referring to FIG. 19, first, the timing controller 600' receives a control signal corresponding to a still image or a moving image from the outside when the organic light emitting display device is driven in the second mode.

If the control signal corresponding to the still image is supplied, the timing controller 600' supplies the first emission control signal ECS1 to the first light emitting driver 200' such that the light emission control signal is supplied during an eleventh period T11 in a period of one frame.

The first light emitting driver 200' receiving the first emission control signal ECS1 supplies the light emission control signal to each of the first light emission control lines E11 to E1*n*. Here, the light emission control signal supplied to each of the first light emission control lines E11 to E1*n* is supplied during the eleventh period T11.

Figure 20:
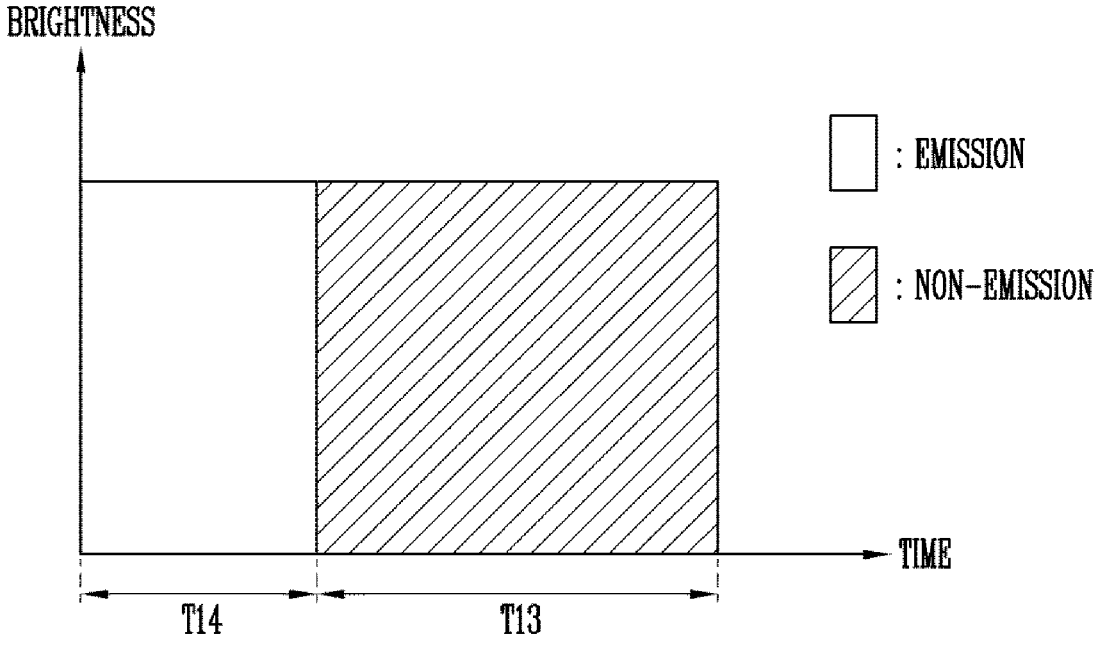
FIG. 20 illustrates light emission and non-light emission of a pixel corresponding to waveforms of FIGS. 18 and 19.
Figure 20:
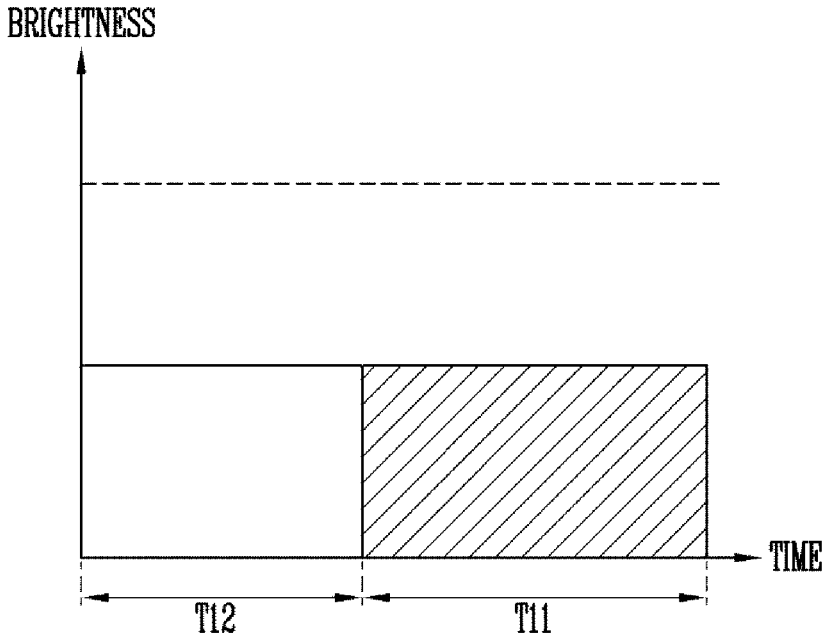

Here, the eleventh period T11 is set to be shorter than the thirteenth period T13. Then, each of the first pixels PXL1 emits light during a twelfth period T12 longer than the fourteenth period T14, as illustrated in FIG. 20. As described above, when the still image is displayed in the first pixel region AA1, if light emission time of the first pixel PXL1 increases, a flicker phenomenon can be minimized.

Meanwhile, if the light emission time of the first pixel PXL1 increases in correspondence with a still image, brightness of the first pixel PXL1 may increase. Accordingly, in the present disclosure, if the still image is displayed in the first pixel region AA1, the second data Data2 with a low gray level is generated as compared with the first data Data1 and the data signal is generated by using the second data Data2.

Here, bits of the second data Data2 are controlled such that the same brightness is displayed in accordance with increase of light emission time.

In addition, although light emission control signal is supplied to each of the light emission control lines E11 to E1*i* once in correspondence with the still image in FIG. 19, the present disclosure is not limited to this.

Figure 21:
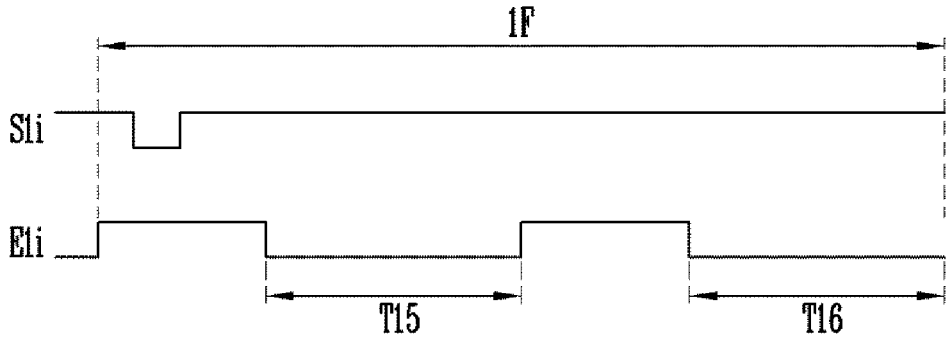
FIG. 21 is a waveform diagram illustrating another embodiment of the driving method when the organic light emitting display device of FIG. 17 is driven in the second mode and displays the still image.

For example, light emission control signals may be supplied to each of the light emission control lines E11 to E1*i* two or more times as illustrated in FIG. 21. However, even in this case, the light emission time may be set to be the same as that of the twelfth period T12 of FIG. 19 (that is, T15+T16=T12).

Figure 22:
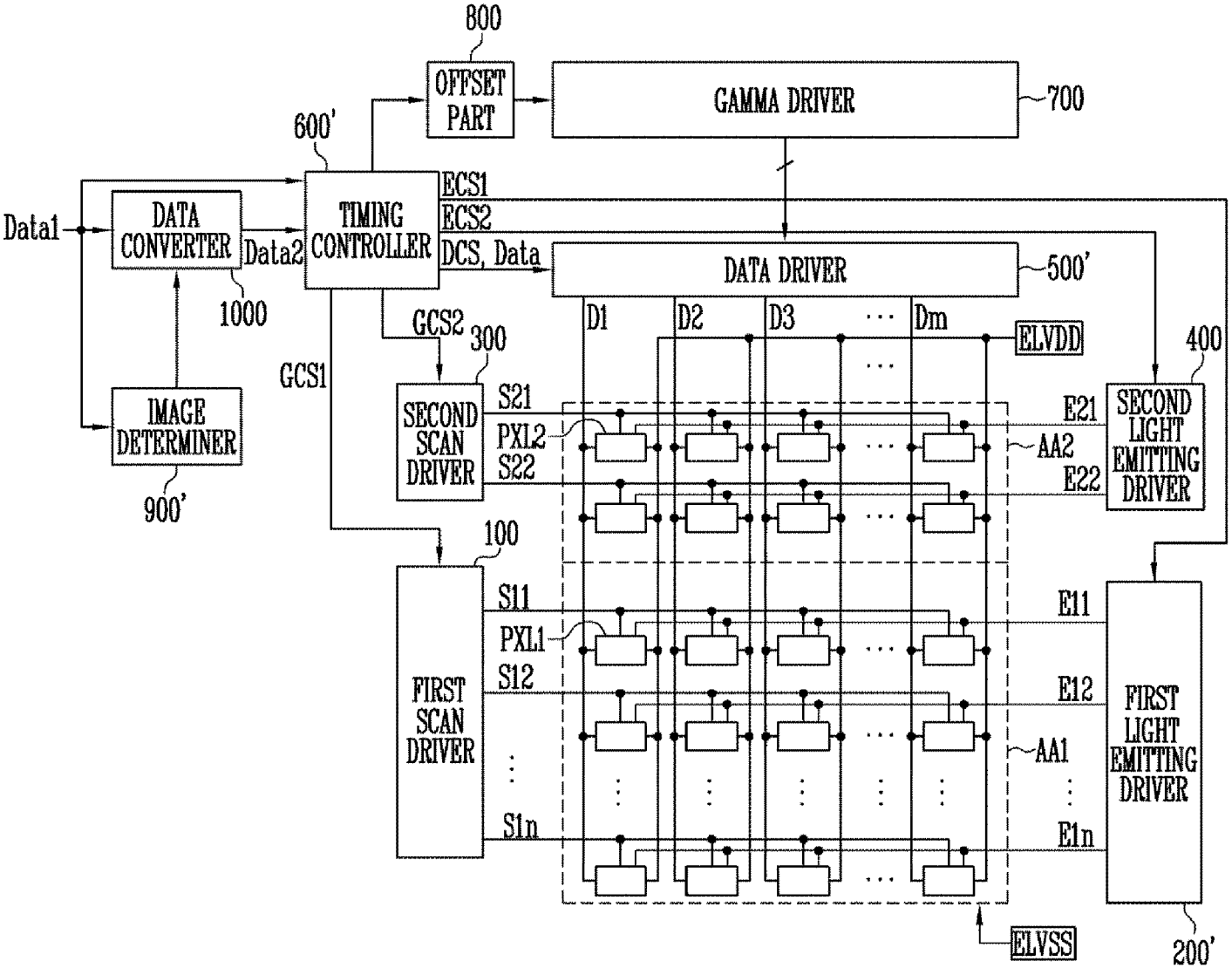
FIG. 22 illustrates still another embodiment of the organic light emitting display device.

FIG. 22 illustrates still another embodiment of the organic light emitting display device. When FIG. 22 is described, the same reference numerals or symbols will be assigned to the same configurations as those in FIG. 17, and detailed description thereof will be omitted.

Referring to FIG. 22, the organic light emitting display device according to another embodiment further includes an image determiner 900'.

The image determiner 900' determines whether an image displayed in the first pixel region AA1 is a moving image or a still image by using data Data. Here, a method of determining an image by using the image determiner 900' may be selected from various known methods. After determining a moving image or a still image, the image determiner 900' supplies a predetermined control signal CS to the timing controller 600'.

Meanwhile, the organic light emitting display device corresponding to FIG. 2 is illustrated in FIGS. 8, 16, 17, and 22. The embodiment may be applied to an organic light emitting display device corresponding to FIG. 5 in the same manner as FIG. 23.

Figure 23:
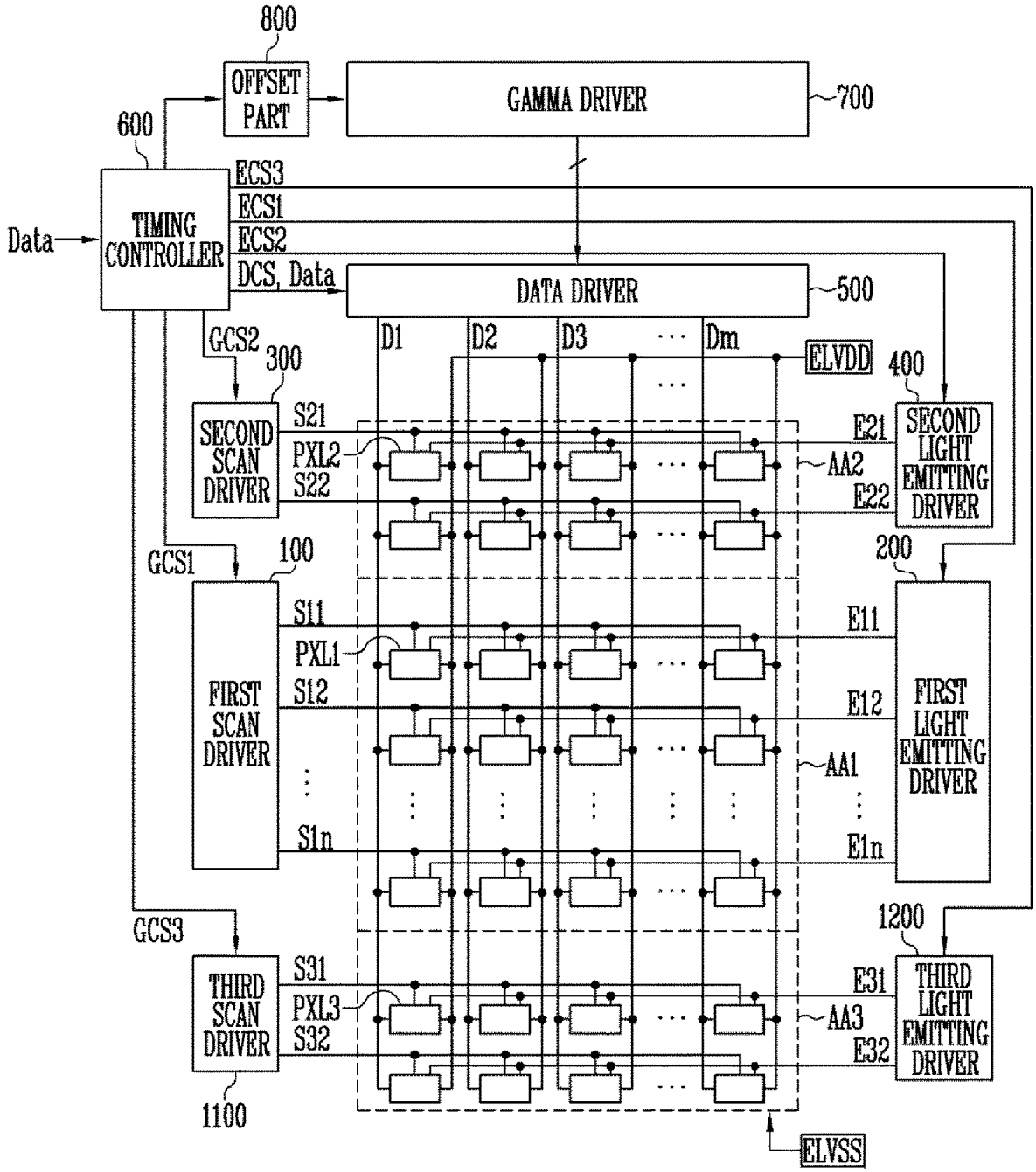
FIG. 23 illustrates still another embodiment of the organic light emitting display device.

FIG. 23 illustrates still another embodiment of the organic light emitting display device. When FIG. 23 is described, the same reference numerals or symbols will be assigned to the same configurations as those in FIG. 8, and detailed description thereof will be omitted.

Referring to FIG. 23, an organic light emitting display device according to still another embodiment of the present disclosure includes the first scan driver 100, the first light emitting driver 200, the second scan driver 300, the second light emitting driver 400, the data driver 500, the timing controller 600, the gamma driver 700, the offset part 800, a third scan driver 1100, and a third light emitting driver 1200.

A pixel region is divided into a first pixel region AA1, a second pixel region AA2, and a third pixel region AA3. The third pixel region AA3 includes third pixels PXL3.

The third pixels PXL3 are connected to third scan lines S31 and S32, third light emission control lines E31 and E32, and data lines D1 to Dm. The third pixels PXL3 are selected when third scan signals are supplied to the third scan lines S31 and S32, and receive the data signals from the data lines D1 to Dm.

The third pixels PXL3 receiving the data signals generate light with predetermined brightness in response to the data signals. Here, number of light emission times of the third pixels PXL3 is controlled by third light emission control signals supplied from the third light emission control lines E31 and E32.

Meanwhile, although two third scan lines S31 and S32 and two third light emission control lines E31 and E32 are illustrated in the third pixel region AA3 in FIG. 23, the present disclosure is not limited to this. For example, two or more third scan lines and two or more third emission control lines may be formed in the third pixel region AA3.

The third scan driver 1100 supplies the third scan signals to the third scan lines S31 and S32 in response to a third gate control signal GCS3 from the timing controller 600. For example, the third scan driver 1100 may sequentially supply the third scan signals to the third scan lines S31 and S32. If the third scan signals are sequentially supplied to the third scan lines S31 and S32, the third pixels PXL3 are sequentially selected by a horizontal line. To this end, the third scan signal is set to a gate-on voltage such that the transistors included in the third pixels PXL3 can be turned on.

Meanwhile, the third scan driver 1100 may supply the third scan signals to the third scan lines S31 and S32 when the organic light emitting display device is driven in the first mode, and may not supply the third scan signals to the scan lines S31 and S32 when the organic light emitting display device is driven in the first mode. In this case, when the organic light emitting display device is driven in the second mode, the third scan lines S31 and S32 are set to a gate-off voltage.

The third light emitting driver 1200 receives the third emission control signal ECS3 from the timing controller 600. The third light emitting driver 1200 receiving the third emission control signal ECS3 supplies the third light emission control signals to the third light emission control lines E31 and E32. For example, the third light emitting driver 1200 may sequentially supply the third light emission control signals to the third light emission control lines E31 and E32. The third light emission control signals are used to control number of light emission times of the third pixels PXL3. To this end, the third light emission control signal is set to the gate-off voltage such that a transistor included in the third pixel PXL3 can be turned off.

Meanwhile, the third light emitting driver 1200 sequentially supplies the third light emission control signals to the third light emission control lines E31 and E32 when the organic light emitting display device is driven in the first mode. In addition, the third light emitting driver 1200 may supply the third light emission control signals to the third light emission control lines E31 and E32 during one frame period when the organic light emitting display is driven in the second mode. In this case, when the organic light emitting display device is driven in the second mode, the third pixels PXL3 are set to a non-light emission state.

While technical ideas of the present disclosure are specifically described in accordance with the preferred embodiments, it should be noted that the embodiments are for description thereof and are not for limiting the description. It will be apparent to those skilled in the art that various modifications may be made without departing from the technical ideas of the present disclosure.

The scope of the above-described disclosure is defined by the appended claims and is not limited to the description of the specification, and all variations and modifications belonging to the equivalent scope of the appended claims will be included in the scope of the present disclosure.

What is claimed is:

1. An organic light emitting display device which is driven in a second mode when being mounted on a wearable device and is driven in a first mode in other cases, comprising:

a first pixel region including first pixels which are driven in response to data signals when the organic light emitting display device is driven in the first mode and the second mode;

a first scan driver which supplies scan signals to first scan lines connected to the first pixels; and a first light emitting driver which supplies light emission control signals to first light emission control lines which are connected to the first pixels, wherein, during one frame period in the second mode, the first light emitting driver supplies K light emission control signals to each of the first light emission control lines when a still image is displayed in the first pixel region, and supplies J light emission control signals to each of the first light emission control lines when a moving image is displayed in the first pixel region, where K is an integer greater than or equal to 2 and J is a positive integer less than K, wherein, during one frame period, total light emission time of the first pixels when the still image is displayed is determined to be substantially the same as total light emission time of the first pixels when the moving image is displayed, and wherein, in the second mode, a gamma voltage corresponding to a low gray level when the still image is displayed is different from a gamma voltage corresponding to the low gray level when the moving image is displayed in the first pixel region such that brightness of the low gray level of the still image and brightness of the low gray level of the moving image are substantially uniform.

2. The organic light emitting display device of claim 1, wherein the K is set to $2^X$ times of the J, where x is a positive integer.

3. The organic light emitting display device of claim 1, further comprising:

a data driver which supplies the data signals to data lines connected to the first pixels;

a gamma driver which supplies gamma voltages to the data driver;

an offset part which stores offset values for controlling the gamma voltages; and a timing controller which controls the offset values.

4. The organic light emitting display device of claim 3, wherein, in the second mode, the timing controller controls the offset values such that the brightness of the low gray level when the still image is displayed becomes less than that when the moving image is displayed in the first pixel region.

5. The organic light emitting display device of claim 4, wherein the low gray level includes at least one gray level of 50 or less gray level.

6. The organic light emitting display device of claim 1, further comprising:

a second pixel region including second pixels which are driven in response to the data signals when the organic light emitting display device is driven in the first mode and are set to a non-light emission state when the organic light emitting display device is driven in the second mode.

7. The organic light emitting display device of claim 6, further comprising:

a third pixel region including third pixels which are driven in response to the data signals when the organic light emitting display device is driven in the first mode and are set to the non-light emission state when the organic light emitting display device is driven in the second mode.

8. An organic light emitting display device which is driven in a second mode when being mounted on a wearable device and is driven in a first mode in other cases, comprising:

a first pixel region including first pixels which are driven in response to data signals when the organic light emitting display device is driven in the first mode and the second mode;

a first scan driver which supplies scan signals to first scan lines connected to the first pixels;

a first light emitting driver which supplies light emission control signals to first light emission control lines which are connected to the first pixels, wherein, during one frame period in the second mode, the first light emitting driver supplies the light emission control signals to each of the first light emission control lines during a first period when a still image is displayed in the first pixel region, and supplies the light emission control signals to each of the first light emission control lines during a second period different from the first period when a moving image is displayed in the first pixel region, wherein, during one frame period in the second mode, the first pixels emit light for a longer time when the still image is displayed than when the moving image is displayed, wherein the data signals are generated by using second data when the organic light emitting display device is driven in the second mode and simultaneously displays the still image in the first pixel region, and the data signals are generated by using first data in other cases, and wherein the second data is generated from the first data and has a lower gray level than the first data such that brightness of the still image and brightness of the moving image are substantially uniform.

9. The organic light emitting display device of claim 8, wherein the first period is shorter than the second period.

10. The organic light emitting display device of claim 8, wherein, during one frame period in the second mode, the first light emitting driver supplies one or more light emission control signals to each of the first light emission control lines when the still image is displayed in the first pixel region.

11. The organic light emitting display device of claim 8, further comprising:

a data converter which changes bits of the first data supplied from an external device to generate the second data, when the organic light emitting display device is driven in the second mode and simultaneously displays the still image in the first pixel region.

12. The organic light emitting display device of claim 8, further comprising:

a second pixel region including second pixels which are driven in response to the data signals when the organic light emitting display device is driven in the first mode and are set to a non-light emission state when the organic light emitting display device is driven in the second mode.

13. The organic light emitting display device of claim 8, further comprising:

a third pixel region including third pixels which are driven in response to the data signals when the organic light emitting display device is driven in the first mode and are set to a non-light emission state when the organic light emitting display device is driven in the second mode.

14. A driving method of an organic light emitting display device that is driven in a second mode when being mounted on a wearable device and is driven in a first mode in other cases, and that includes pixels which are turned off when a light emission control signal is supplied, the driving method comprising:

supplying K light emission control signals to each of light emission control lines, when the organic light emitting display device is driven in the second mode and a still image is displayed in a pixel region; and supplying J light emission control signals to each of the light emission control lines, when the organic light emitting display device is driven in the second mode and a moving image is displayed in the pixel region, where K is an integer greater than or equal to 2 and J is a positive integer less than K, wherein, during one frame period, total light emission time of the pixels when the still image is displayed is determined to be substantially the same as total light emission time of the pixels when the moving image is displayed, and wherein, in the second mode, a gamma voltage corresponding to a low gray level when the still image is displayed is different from a gamma voltage corresponding to the low gray level when the moving image is displayed in the first pixel region such that brightness of the low gray level of the still image and brightness of the low gray level of the moving image are substantially uniform.

15. The driving method of an organic light emitting display device of claim 14, wherein the K is set to $2^X$ times of the J, where x is a positive integer.

* * * * *